US005499938A

United States Patent [19]

Nakamoto et al.

[11] Patent Number: 5,499,938

[45] Date of Patent: Mar. 19, 1996

[54] FIELD EMISSION CATHODE STRUCTURE, METHOD FOR PRODUCTION THEREOF, AND FLAT PANEL DISPLAY DEVICE USING SAME

[75] Inventors: Masayuki Nakamoto; Tomio Ono; Tadashi Sakai, all of Yokohama, Japan

[73] Assignee: Kabushiki Kaisha Toshiba, Kanagawa, Japan

[21] Appl. No.: 291,937

[22] Filed: Aug. 16, 1994

Related U.S. Application Data

[63] Continuation-in-part of Ser. No. 38,936, Mar. 29, 1993, abandoned.

[30] Foreign Application Priority Data

| | | | |
|---|---|---|---|
| Jul. 14, 1992 | [JP] | Japan | 4-186753 |
| Aug. 17, 1993 | [JP] | Japan | 5-203167 |
| Dec. 27, 1993 | [JP] | Japan | 5-332043 |

[51] Int. Cl.[6] ..... H01J 9/02

[52] U.S. Cl. ..... 445/50

[58] Field of Search ..... 445/24, 50, 49

[56] References Cited

U.S. PATENT DOCUMENTS

| | | | |
|---|---|---|---|
| 4,307,507 | 12/1981 | Gray et al. | 437/228 |
| 4,721,885 | 1/1988 | Brodie | 313/576 |
| 5,038,070 | 8/1991 | Bardai et al. | 313/309 |
| 5,140,219 | 8/1992 | Kane | 313/495 |
| 5,166,709 | 11/1992 | Kubelik | 346/155 |
| 5,221,221 | 6/1993 | Okaniwa | 445/24 |
| 5,254,137 | 6/1993 | Mitani | 29/25.03 |
| 5,270,258 | 12/1993 | Yoshida | 445/50 |

FOREIGN PATENT DOCUMENTS

| | | | |
|---|---|---|---|
| 160740 | 12/1981 | Japan | 445/50 |
| 615780 | 2/1980 | Switzerland . | |

OTHER PUBLICATIONS

Spindt et al., "Physical Properties of Thin–Film Field Emission Cathodes With Molybdenum Cones," Journal of Applied Physics 47(12):5248–5263 (1976).

M. Sokolich et al., "Field Emission From Submicron Emitter Arrays," Technical Digest of the International Electron Devices Meeting 1990, San Francisco, CA, Dec. 9–12, 1990, pp. 159–162.

*Primary Examiner*—Kenneth J. Ramsey

*Attorney, Agent, or Firm*—Finnegan, Henderson, Farabow, Garrett & Dunner

[57] ABSTRACT

A field emission cathode which comprises an emitter provided with a sharp point for emission of electrons and a controlling gate electrode is composed of a supporting substrate, an emitter material layer formed of an emitter material, superposed on and attached fast to the supporting substrate, and provided with an emitter hole, an insulator layer so formed on the surface of the emitter material layer as to expose the tip part of the emitter projection therethrough, and an impurity diffusion layer formed on the surface of the insulator layer and enabled to function as an etching stopper layer. The method for the production of the field emission cathode comprises a step of forming a first hole pointed toward the leading end thereof on a first supporting substrate, a step of forming the impurity diffusion layer on the surface of the first supporting substrate, a step of forming the insulator layer on the surface of the impurity diffusion layer, a step of depositing an emitter material layer on the surface of the insulator layer including a hole while filling the hole with an emitter material thereby giving rise to a laminate, a step of integrally joining a second supporting substrate to the surface of the emitter material layer of the laminate, a step of removing by etching the first supporting substrate thereby exposing the surface of the impurity diffusion layer including the projection corresponding to the first hole, and a step of selectively removing the impurity diffusion layer and the insulator layer thereby exposing a tip of the projection of the emitter layer.

16 Claims, 12 Drawing Sheets

FIELD EMISSION CATHODE STRUCTURE, METHOD FOR PRODUCTION THEREOF, AND FLAT PANEL DISPLAY DEVICE USING SAME

This is a continuation-in-part of application Ser. No. 08/038,936 filed Mar. 29, 1993 now abandoned.

BACKGROUND OF THE INVENTION

The present application claims priority of Japanese Patent Application No. Hei-4-186753 filed on Jul. 14, 1992, Japanese Patent Application No. Hei-5-203167 filed on Aug. 27, 1993 and Japanese Patent Application No. Hei-5-332043 filed on Dec. 17, 1993.

FIELD OF THE INVENTION AND RELATED ART STATEMENT

This invention relates to a field emission cathode structure, a method for the production thereof, and a flat panel display device using the cathode.

In recent years, the advanced technology on the fabrication of Si semiconductors has been lending itself immensely to the development of field-emission type cathode structures and to the utilization of these cathodes in ultraspeed microwave devices, power devices, electron beam devices, flat panel display devices, etc. As a typical example of the cathode, what has been reported by C. A. Spindt et al. in Journal of Applied Physics, Vol. 47, No. 12, December 1976, pages 5248–5263 has been known to the art.

The field emission cathode structure disclosed therein, as illustrated in FIG. 9*a*, FIG. 9*b*, and FIG. 9*c* of the present specification, is produced by forming a $SiO_2$ layer 2 as an insulating layer by the technique of deposition such as CVD on a Si single crystal substrate 1, further forming thereon a Mo layer 3 destined to serve as a gate electrode layer as by the electron beam vacuum deposition technique, boring a pinhole 5 approximately 1.5 μm in diameter through the layers 2 and 3 by means of etching, then forming an Al layer 4 destined to serve as a separating layer by means of vacuum deposition [FIG. 9*a*], vacuum depositing thereon a metal such as Mo which is destined to form an emitter as by the technique of electron beam vacuum deposition while keeping the Si single crystal substrate 1 in rotation thereby giving rise to a conical pile of Mo inside the pinhole 5 by utilizing the phenomenon that the diameter of the pinhole 5 converges in proportion as the deposition of Mo proceeds [FIG. 9*b*], and finally finishing a conical emitter 7 by peeling the Al separating layer 4 and removing the Mo layer 6 [FIG. 9*c*].

The electronic device using a cathode structure such as, for 45example, the flat panel display device is constructed by causing a Si single crystal substrate 1 having a multiplicity of such cathodes superposed thereon to be opposed across a prescribed interval to a glass face plate 8 having a phosphor layer superposed thereon as illustrated in FIG. 10. In this diagram, A stands for a region for the formation of cathodes. This flat panel display device using field emission cathodes is different from the display device using a liquid crystal in being a luminescent type. It obviates the necessity for using a back light and consequently promises a saving in power consumption. Owing to these features, it has been attracting keen attention.

The conventional method for producing the field emission cathode system, the field emission cathode structure obtained by the method, and the electronic devices using such cathode structures, however, entail the following important problems.

Firstly, in the conventional method for rotary vacuum deposition described above, since the formation of the emitter 7 inside the pinhole 5 is attained by utilizing the phenomenon that the diameter of the pinhole 5 bored in the Mo layer 3 gradually converges, the height of the emitter and the shape of the tip of the emitter are liable to loss of consistency. The cathode structure which is obtained by this method, therefore, produces field emission with poor uniformity and lacks the sharpness of the tip of the emitter which is necessary for improving the efficiency of field emission and, as a result, entails such problems as decline of the efficiency of field emission and growth of power consumption. Further, the fact that the reproducibility of shape and the yield of production are both inferior gives rise to a problem of extremely high cost of production in the fabrication of a multiplicity of field emission cathode structures on one and the same substrate.

Secondly, since the $SiO_2$ insulating layer is formed by the technique of CVD, the distance between the gate and the emitter on which the efficiency of field emission heavily hinges defies accurate control, and the magnitudes of field emission which the plurality of cathode structures severally generate lack uniformity. In the production of a flat panel display device, for example, the picture elements corresponding to the individual cathode structures are suffered to betray inconsistency of luminance. As respects the flat panel display device, owing to the slight loss of consistency in the distance between the gate and the emitter and in the shape of the tip of the emitter, it often happens that the ratio of the current of electrons between the gate and the emitter to the current of electrons between the anode and the emitter increases. There are times when the current of electrons between the gate and the emitter even reaches 60% of the total current of electricity. Thus, the problem arises that the efficiency of light emission of the picture elements (fluorescent elements) corresponding to the individual cathode structures is degraded and, at the same time, the picture elements suffer from serious inconsistency in luminance.

Thirdly, the size of the Si single crystal substrate imposes a limit on the regions to be used for the formation of field emission cathode structures or the number of such cathode structures to be formed and, at the same time, impairs the productivity of the cathode structures. This fact implies that the flat panel display device using a multiplicity of cathode structures is limited in size. Further, the flat panel display device by nature is fated to use the Si single crystal substrate as part of the housing of the device. As a vacuum container, the housing is conspicuously deficient in strength. Especially, when the image screen grows in size, the housing retains required strength only with increasing difficulty.

Fourthly, since the emitter is formed by depositing the Si single crystal substrate or conductive substrate concurrently serving as a cathode, the continuity between the emitter and the cathode is disrupted along their interface no matter whether the material for the emitter and that for the cathode are different or same. Thus, the disadvantage arises that the emitter will peel and incur loss of resistance and, consequently, generate heat possibly to the extent of deteriorating the emitter itself.

For the sake of eliminating the limit on size and enhancing the strength of the housing, an idea of superposing the Si single crystal substrate fast on a structural substrate such as a glass substrate may be conceived. The mere superposition results in an addition to the thickness of the cathode part and proves unfit for such electronic devices which are directed toward decreasing weight and thickness, for example. The substitution of a glass substrate for the Si single crystal substrate indeed eliminates the problems on size mentioned above. It, however, necessitates formation of a conductive layer on the glass substrate for the purpose of ensuring maintenance of conductivity to the emitter. Thus, the formation of the $SiO_2$ insulating layer does not permit adoption of the technique of CVD but requires use of the technique of electron beam vacuum deposition or the technique of spattering. The $SiO_2$ insulating layer which is obtained by such a technique, however, assumes a more porous texture and contains more pinholes than the layer obtained by the technique of CVD and suffers from aggravated inconsistency in the distance between the gate and emitter which governs the efficiency of field emission.

The flat panel display device using the conventional field emission cathode structures entails the following problems in addition to the problems pertaining to the process of manufacture of cathode structures mentioned above. When the field emission cathode structures are used, in spite of an increase in the voltage applied between the cathode and the anode to a level of about 100 V, the energy of the electron beam is small as compared with that of the ordinary C-CRT and the fluorescent elements collect electric charge on their surfaces possibly to the extent of repelling the electron beam. Thus, the problem arises that the infiltration of electrons in the fluorescent elements occurs only to several nm from their surfaces and the fluorescent elements suffer from poor efficiency of emission. When the applied voltage is increased, the energy of the electron beam is augmented and the efficiency of emission is enhanced and, at the same time, the practicability of allowing use of fluorescent elements which avoid inducing saturation of luminance and excel in efficiency of emission is realized. The increased voltage, however, entails such problems as ionization of impurity gas and consequent spattering of the surface of the cathode and breakdown of the insulation between the gate and the cathode. Since these circumstances compel the applied voltage lower than that normally used in the C-CRT, the efficiency of emission which is actually obtained is lower than that which is obtained inherently.

As a way of compensating, if only nominally, this decline of the luminous efficiency, the method which consists in coating the surface of the fluorescent face plate opposite the surface thereof intended for observation, namely the fluorescent rear surface, with aluminum thereby forming a so-called metal back and enabling the metal back to reflect the light radiated on the fluorescent rear surface side toward the observation surface side may be cited. This method has found extensive utility in the ordinary C-CRT devices. The use of the metal back, however, necessitates application of a high voltage even reaching the range from 6,000 V to 8,000 V for enabling the electron beam to pass through the Al layer and, consequently, entails the aforementioned problems of spattering and breakdown of the cathode, and renders it extremely difficult to maintain mutual insulation of the anode and the cathode because the gap intervening between them is as narrow as to fall in the range of from several μm to 1 mm.

As described above, the method for the production of the conventional field emission cathode structure poses various problems such as degradation and inconsistency of the efficiency of field emission and inferiority of the yield of production owing to the marked deficiency of the shape of the emitter in reproducibility and uniformity and, at the same time, entails such problems as restriction of the region for the formation of the field emission cathode structure by the size of the Si single crystal substrate and inevitable use of the Si single crystal substrate as part of the housing of the device.

With a view to improving the reproducibility and uniformity of the shape of emitter, Sokolich et al. (IEDM 90, pages 159–162) have developed a method for arranging uniform tips on a polysilicon substrate by forming in a <100> Si single crystal substrate by the etching technique a pyramidal hole having a sharp bottom tip, forming on the surface of the hole a thin oxide film as an etching barrier, subsequently depositing polysilicon in the Si mold wafer, and further removing the mold wafer by etching. The polysilicon tips thus produced are coated as with Mo, overcoated with a $SiO_2$ film by the CVD technique, further coated with a layer of grid metal, and then finished as field emission cathodes.

This method of manufacture proposed by Sokolich et al., however, has the following problems. When the mold layer is used, the tips are discernibly improved in reproducibility and uniformity as compared with those obtained by the rotary vapor deposition method described above. The sharpness of the tips does not necessarily deserve to be called sufficient, because of the difficulty of coating emitter material on the sharp emitter tips, and the emitter material coated on polysilicon is sometimes peeled off. Further, since the $SiO_2$ film is formed by the CVD technique, the gaps intervening between the gates and the emitters defy control and permit no easy decrease. Thus, it has been difficult for this film to be produced in high quality.

As respects the flat panel display device which uses the conventional field emission cathode structure, even when the device is relieved of the problems which pertain to the emitter, it still entails such structural problems as inferior efficiency of emission (luminance) of picture elements and serious inconsistency of luminance.

SUMMARY OF THE INVENTION

This invention has been produced for the purpose of solving the problems of the prior art described above.

One object of this invention is to provide a method for the production of a field emission cathode structure which permits easy fabrication of emitters excelling in reproducibility and uniformity of shape, allows accurate control of the intervals between gates and emitters, enables the region for the formation of emitters to be easily increased in area without entailing any addition to the thickness of the cathode structure, and abounds in productivity.

Another object of this invention is to provide a field emission cathode structure which excels in efficiency and uniformity of electron emission and exhibits ample strength in the case that it is used as part of the housing of the device.

A further object of this invention is to provide a field emission cathode structure which incurs such adverse phenomena as separation and deterioration only sparingly.

Yet another object of this invention is to provide a flat panel display device which is adapted to improve the quality of the displayed image by augmenting the luminance of emission of the picture elements and, at the same time, curbing the inconsistency of luminance among the picture elements.

The first method of this invention for the production of a field emission cathode structure is characterized by comprising a step of providing a first substrate with holes with a sharp point, a step of forming an insulating layer on the surface of the first substrate inclusive of the interiors of the holes, a step of forming an emitter material layer on the insulating layer while filling the interiors of the holes with the emitter material layer, a step of joining the first substrate with a second substrate formed of a structural substrate in such a manner as to have the emitter material layer interposed therebetween, a step of removing the first substrate by etching thereby exposing the insulating layer and, at the same time, allowing protrusions conforming to the part of the emitter material filling the interiors of the holes to thrust out, a step of forming a gate electrode layer on the exposed insulating layer, and a step of removing part of the insulating layer and gate electrode layer thereby forming an emitter.

The field emission cathode system of this invention is obtained by the method for production mentioned above, which field emission cathode system is characterized by comprising a structural substrate, an emitter material layer superposed fast on the structural substrate and provided with protruding emitters with a sharp point, an insulating layer formed on the emitter material layer in such a manner as to expose the points of the emitters, and a gate electrode layer formed along the shape of the emitters through the medium of the insulating layer and, at the same time, provided with opening parts encircling the points of the emitters.

The second method of this invention for the production of a field emission cathode structure comprises a step of first forming a first hole having a sharp pointed tip on a first main surface of a first supporting substrate, a step of forming a high-concentration impurity diffusion layer on the main surface of the impurity diffusion layer including the wall surfaces of the first hole, a step of forming an insulator layer on the surface the impurity diffusion layer including a second hole formed to cover the first hole, a step of forming a smooth emitter material layer surface on the surface of the insulator layer including a third hole formed to cover the second hole and meanwhile filling the third hole with an emitter material, a step of integrally joining a second supporting substrate to the surface of the emitter material layer, a step of removing by etching the first supporting substrate and exposing the impurity diffusion layer including the projection corresponding to the first hole, and a step of selectively removing the impurity diffusion layer and the insulator layer in the tip part of the projection thereby exposing the tip part of the projection formed of the emitter material.

The field emission cathode according to the second method comprises a supporting substrate, an emitter material layer formed on the surface of the supporting substrate and provided with an emitter projection having a sharp pointed tip, an insulator layer formed on the emitter material layer and adapted to expose the tip part of the emitter projection, and a high-concentration impurity diffusion layer formed on the insulator layer and adapted to expose the tip part of the emitter projection.

The field emission cathode according to the second method has originated in the interest drawn to the fact that a pyramidal or conically hole having a sharp pointed tip can be formed on the surface of a supporting substrate such as, for example, a Si single crystal substrate by harnessing the anisotropy of etching, the fact that a layer having an impurity diffused therein functions as an etching stopper layer, the fact that the impurity diffusion layer also functions as a gate electrode layer depending on the magnitude of resistance thereof, and the fact that an oxide layer (insulator layer) having a sharp pointed tip part is formed along a prescribed surface by the use of the thermal oxidation method.

In the field emission cathode and the method for the production thereof contemplated by the present invention, the first supporting substrate may be made of any material which satisfies the condition that it should permit a hole of a sharp pointed tip to be selectively formed therein and exhibit a selective etching property with respect to an insulating layer and a high-concentration impurity diffusion layer to be integrally joined thereto. It is, however, desired to be a Si or Ge single crystal substrate in due respect of the ease with which the high-concentration impurity diffusion layer is formed and the ease with which the formation of an insulator layer rich in accuracy of film thickness and shape is controlled.

Silicon (Si) containing boron (B) as a p-type impurity at a concentration of not less than $3\times10^{19}$ $cm^{-3}$ may be cited as one example of the material for the high-concentration impurity diffusion layer. When the concentration of this impurity is as high as about $10^{20}$ to $10^{21}$ $cm^{-3}$, the high-concentration impurity diffusion layer can be used concurrently as a gate electrode layer because the electric resistance is as low as about $10^{-4}$ $\Omega\cdot$cm. It should be noted, however, that the material for the impurity diffusion layer does not need to be limited to the particular substance mentioned above. It is only required to be such that the impurity diffusion layer may function as an etching stopper layer when the first supporting substrate is removed by etching. It may be an n-type material or an i-type material instead of the p-type material mentioned above.

Further, the insulator layer may be formed by depositing $SiO_2$ on the surface of the impurity diffusion layer mentioned above by the use of the CVD method, for example. The insulator layer, however, is desired to be formed by subjecting the surface of the impurity diffusion layer mentioned above to the process of thermal oxidation because this process imparts a dense texture to the produced layer and permits easy control of the thickness of the layer and allows the insulator layer having a sharp pointed tip to be formed along the wall surfaces of a pyramidal hole, for example.

In the method for the production of the field emission cathode according to this invention, since the high-concentration impurity diffusion layer destined to serve as an etching stopper layer and the insulator layer such as, for example, a thermally oxidized insulating layer are superposed on the surface of the first supporting substrate such as, for example, a Si single crystal substrate including the hole formed therein and the emitter material layer is subsequently superposed thereon, the thermally oxidized insulation layer can be formed as easily controlled and, therefore, the distance between the gate and the emitter can be controlled with high accuracy. Even when the insulator layer is formed in the smallest possible thickness for the purpose of closely approximating the gate and the emitter to each other, the supporting substrate can be removed by etching without exposing the insulator layer and the emitter material layer to the possibility of corrosion because the impurity diffusion layer functions as an etching stopper layer. Since the thermally oxidized insulation layer and the emitter material layer are protected against the corrosion by the etching liquid as described above and also since the distance between the gate and the emitter is decreased, the field emission efficiency and the uniformity of the field emission cathode are improved to a great extent.

Besides, since the emitter material is disposed as embedded (filled) in the hole formed in the supporting substrate and the hole is formed with high accuracy as well, the emitter which is uniform in height, shape, and sharpness of sharp pointed tip is manufactured with high repeatability. In the hole formed in the supporting substrate, the tip of the hole gains in sharpness because the growth of the thermally oxidized insulation layer on the inner wall surfaces of the hole advances toward the interior of the hole. As a natural consequence, the tip part of the emitter formed by filling the emitter material in the hole becomes sharp (refer to FIG. 11*b*).

The high-concentration impurity diffusion layer primarily functions as an etching stopper layer. When it has a high p-type impurity concentration and enjoys high electric conductivity, it can be used directly as a gate electrode layer. When the etching stopper layer is concurrently used as a gate electrode layer, this layer and the insulator layer which has been formed as ideally controlled cooperate to permit accurate control of the distance between the gate and the emitter and the mutual approximation thereof and, at the same time, obviates the necessity of the step for the formation of the gate electrode layer. The omission of this step naturally results in reducing the labor, man-hour, and material cost involved in the production of the field emission cathode of this invention.

In addition to the first and the second methods, we will describe the other methods to which the above methods are applied. The third method is characterized by comprising a step of incising a hole having a sharp pointed bottom part on a first main surface side of a first supporting substrate, a step of forming an insulating layer on the first main surface of the first supporting substrate including the inner walls of the hole, a step of depositing an emitter material on the surface of the insulating layer while filling the emitter material in the hole thereby forming an emitter material layer provided with a projection having a sharp pointed tip, a step of joining a second supporting substrate to the surface of the emitter material layer opposite to the surface thereof on which the projection is formed thereby causing the second supporting substrate to support the emitter material layer, a step of removing by etching the first supporting substrate from the second main surface side thereof until at least the tip part of the insulating layer covering the projection of the emitter material layer is exposed, and until the end of a tip of the projection of the emitter material layer provided with the projection corresponding to the hole falls flush with the surface of the first supporting substrate after completion of the etching, and a step of progressively etching the insulating layer from the portion thereof exposed from the first supporting substrate thereby effecting selective removal by etching of the insulating layer, exposing the tip part of the projection of the emitter material layer previously covered by the insulating layer and consequently forming an emitter and, at the same time, allowing the first supporting substrate to remain at least in such a manner as to be opposed across a gap to the tip part of the emitter and forming a gate layer.

The fourth method is alternatively characterized by comprising a step of forming an etching stopper layer on a first main surface of a first supporting substrate, a step of incising on the first main surface side of the first supporting substrate a hole having a sharp pointed bottom part through the etching stopper layer to a depth reaching halfway along the thickness of the first supporting substrate, a step of forming an insulating layer on the etching stopper layer including the inner wall surfaces of the hole, a step of depositing an emitter material on the surface of the insulating layer while filling the emitter material in the hole thereby forming an emitter material layer provided with a projection having a sharp pointed tip, a step of removing by etching the first supporting substrate from the second main surface side of the substrate until the etching stopper layer thereby exposing the tip part of the insulating layer covering the projection of the emitter material layer through the surface of the etching stopper layer, and a step of progressively etching the insulating layer from the portion thereof exposed through the etching stopper layer thereby selectively removing by etching the insulating layer, exposing the tip part of the projection of the emitter material layer previously covered by the insulating layer and forming an emitter and, at the same time, allowing the etching stopper layer to remain at least in such a manner as to be opposed across a gap to the tip part of the emitter and forming a gate layer.

In the method of this invention for the production of the field emission cathode structure, since the insulating layer is first formed on the first substrate provided with the holes and the emitter material layer is subsequently formed, the gaps between the gates and the emitters can be controlled with high accuracy. The emitters correspond to the parts of the emitter material filling the interiors of the holes formed in the first substrate. When the holes are accurately formed in advance, therefore, the emitters having a sharp point and excelling in height can be obtained with ideal reproducibility. When the insulating layer is formed of a thermally oxidized $SiO_2$ layer, the points of the produced emitters have greater sharpness because the $SiO_2$ layer is formed in a swelled state on the inner walls of the holes. These emitters are conspicuously improved in efficiency and uniformity of field emission. Since the emitter material layer is formed on the first substrate and joined to the structural layer and, thereafter, the first substrate which is no longer necessary is dissolved and removed, a multiplicity of first substrates having emitters formed thereon can be integrally formed on one structural substrate. As a result, the area for the formation of cathodes can be easily enlarged and, at the same time, the productivity of cathode structure can be enhanced. Further, the structural substrate can be maintained in a small thickness.

The flat panel display device of this invention is provided with a face plate having a phosphor layer and an anode electrode layer sequentially superposed therein and a field emission cathode plate opposed to the phosphor layer and fitted with a cathode electrode layer, emitters formed on the cathode electrode layer, and a gate electrode layer adapted to control the flows of electrons discharged from the emitters, which flat panel display device is characterized by having a second phosphor layer formed on the gate electrode layer around the emitters and/or in the emitter opening parts of the gate electrode layer.

In the flat panel display device of this invention, since the second phosphor layer is formed on the gate electrode layer around the emitters and/or in the emitter opening parts of the gate electrode layer, the currents of electrons flowing between the gates and the cathodes which generally make no contribution to the emission of light enable the second phosphor layers to emit light efficiently. The light thus emitted is reflected by the gates of a metallic substance. The gates, therefore, fulfill the function of a metal back. Thus, this light coupled with the light emitted from the fluorescent material on the gate electrode layer and the light emitted from the fluorescent material on the face plate enhances the efficiency of emission and the luminance of the emitted light. When the electric currents flowing between the anodes and the cathodes are deprived of consistency by changes in the distances between the gates and the cathodes and the distances between the cathodes and the anodes, the possible loss of consistency of the total amount of emitted light (inconsistency of luminance among picture elements) can be curbed by the light emitted from the phosphor layer formed on the gate electrode layer.

DESCRIPTION OF THE PREFERRED EMBODIMENTS

Now, this invention will be described below with reference to working examples of this invention illustrated in the annexed drawings.

Embodiment 1:

FIG. 1 is a diagram illustrating a process for the production of a field emission cathode structure as one embodiment of this invention. The method for producing the field emission cathode structure in this embodiment will be described below with reference to this diagram.

Figure 1A:
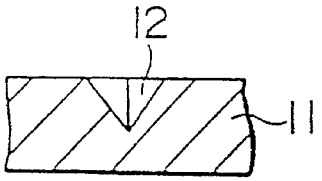
FIGS. 1*a*, 1*b*, 1*c*, 1*d*, 1*e*, 1*f*, 1*g* and 1*h* are cross sections illustrating a process for the production of a field emission cathode structure as one embodiment of this invention.

First, a hole of a pointed bottom is formed in a first substrate. As a method for forming the hole of this sort, the method which utilizes anisotropic etching of a Si single crystal substrate as shown below may be cited. First, a thermally oxidized film of $SiO_2$ approximately 0.1 μm in thickness is formed by the technique of dry oxidation on a p-type Si single crystal substrate of a (100) crystal plane orientation and a resist is applied thereto by the technique of spin coating. Then, the resultant superposed layers are subjected to such patterning operations as exposure and development by the use of a stepper so as to form opening parts each of the square of 1 μm. The $SiO_2$ film is etched with a mixed $NH_4F.HF$ solution. By performing the anisotropic etching with an aqueous 30 wt % KOH solution after the removal of the resist, the hole 12 of the shape of an inverted pyramid 12 is formed to a depth of 0.71 μm in a Si single crystal substrate 11 as illustrated in FIG. 1*a*.

Figure 1B:
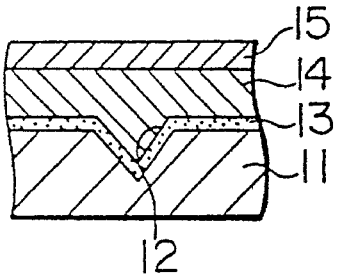

Then, the $SiO_2$ film is provisionally removed by the use of a mixed $NH_4F.HF$ solution and a thermally oxidized insulating layer 13 of $SiO_2$ is superposed on the Si single crystal substrate 11 inclusive of the interior of the hole 12 as illustrated in FIG. 1*b*. In the present example, the thermally oxidized insulating layer 13 of $SiO_2$ was formed in a thickness of 0.5 μm by the technique of wet oxidation. Optionally, this insulating layer 13 may be formed by depositing $SiO_2$ as by the technique of CVD. Since the thermally oxidized layer of $SiO_2$ has a dense texture and allows easy control of the thickness thereof and also since the fact that the thermally oxidized layer is formed in a swelled state on the inner wall of the holes brings about an effect of imparting enhanced sharpness to the tips of the holes, the present working example adopted a thermally oxidized film for the insulating layer and selected the thickness of this thermally oxidized film in the range of from 0.03 μm to 0.8 μm in due consideration of the role to be performed by the insulating layer and on condition that the opening parts have a size of 1 μm. of course, this thickness is subject to change depending on the size of the opening parts and the magnitude of voltage to be applied.

The thermally oxidized layer of $SiO_2$ also functions as an etching stopper layer, in addition to the effect of enhanced sharpness to the tips of the emitter.

Subsequently, a W layer or a Mo layer, for example, is formed as an emitter material layer 14 on the aforementioned thermally oxidized layer 13 of $SiO_2$. The emitter material layer 14 is formed in such a manner that it will thoroughly fill up the holes 12 and, at the same time, permit continuity of the holes 12 to the other parts. In the present working example, the emitter material layer 14 was formed in a thickness of 2 μm by the technique of spattering. The emitter material layer of this invention is not always required to fulfill the part of a structural layer. Generally, therefore, the thickness of the emitter material layer 14 approximately in the range from 0.1 to 5 μm suffices. Further, an ITO conductive layer 15 is formed in a thickness of 1 μm, for example, similarly by the technique of spattering. Incidentally, this conductive layer 15 may be omitted, depending on the kind of substance of the emitter material layer 14. When this omission is effected, the emitter material layer 14 concurrently serves as a cathode electrode layer.

When, in this case, the emitter material layer 14 and the cathode electrode are formed of one same material, the field emission cathode structure to be obtained suffers from separation and deterioration only sparingly and enjoys ideal quality because they are enabled to share a continued texture.

Figure 1C:
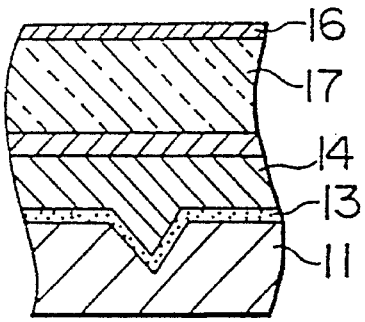

In the meanwhile, a Pyrex glass substrate (1 mm thick) 17 having the rear surface thereof coated with an Al layer 16 of a thickness of 0.3 μm is prepared as a structural substrate destined to form a second substrate and the glass substrate 17 and the Si single crystal substrate 11 mentioned above are interjoined through the medium of the emitter material layer 14 as illustrated in FIG. 1*c*. For this junction, the technique of electrostatic bonding can be adopted. The electrostatic bonding technique is effected by applying an electric field of 50 to 500 V with the emitter side as the plus pole and the glass substrate side as the negative pole. This technique contributes to decreasing the weight and thickness of the cathode device to be produced.

Figure 1D:
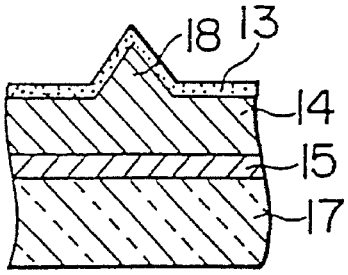
Figure 1E:
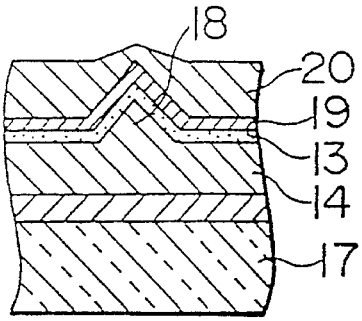

The Al layer 16 on the rear surface of the glass substrate 17 is removed with a mixed acid solution of $HNO_3.CH_3COOH.HF$ and then the Si single crystal substrate 11 alone is removed by etching with a mixed aqueous solution of ethylene diamine, pyrocatechol, and pyrazine (ethylene diamine:pyrocatechol:pyrazine:water= 75 cc:12 g:3 mg:10 cc). At this time, the thermally oxidized layer of $SiO_2$ 13 effects as an etching stopper layer, the thermally oxidized insulating layer 13 of $SiO_2$ is exposed and, at the same time, pyramidal protrusions 18 of the emitter material covered by the thermally oxidized insulating layer 13 of $SiO_2$ as the etching stopper are thrusted out as illustrated in FIG. 1*d*. The pyramidal protrusions 18 correspond to the parts of the emitter material filling the interiors of the holes 12 in the Si single crystal substrate 11. Then, as a gate electrode layer 19, a W layer, for example, is formed on the thermally oxidized insulating layer 13 of $SiO_2$ along the shapes of the protrusions 18 covered with the thermally oxidized insulating layer of $SiO_2$ as illustrated in FIG. 1*e*. In the present working example, the W layer 19 was formed in a thickness of 0.5 μm by the technique of sputtering. Further, a photoresist 20 is formed to such an extent that the tips of the protrusions 18 covered with the gate electrode layer 19 and the thermally oxidized insulating layer 13 of $SiO_2$ may be slightly concealed. In the present working example, the photoresist 20 was applied in a thickness of about 0.9 μm by the technique of spin coating.

In the above, when the gate electrode layer is formed, the thermally oxidized insulating layer of $SiO_2$ 13 which functions as the etching stopper layer is left as an insulator.

Though the insulating quality decreases, if it is necessary to provide the distance between the gate electrode 19 and the emitter more widely, the thermally oxidized insulating layer of $SiO_2$ 13 may be removed by etching with the mixed solution of $NH_4F$ and HF, and a Si oxidized layer may be deposited by the CVD method or the electron beam vacuum depositing method to form a new $SiO_2$ layer having a desired thickness, thereby the distance between the gate electrode 19 and the emitter being selected freely.

Figure 1F:
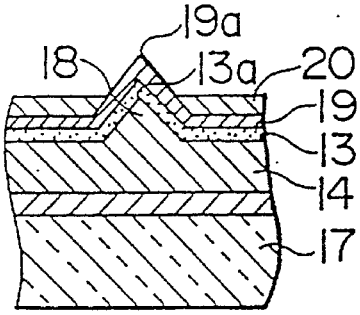
Figure 1G:
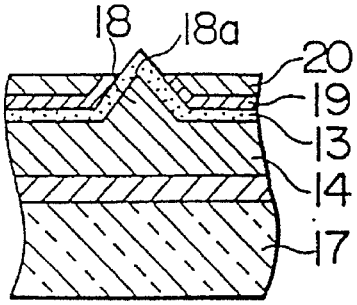

The photoresist 20 is removed by dry etching with oxygen plasma in such a manner that tips 19*a* of the gate electrode layer 19 (inclusive of the tips 13*a* of the thermally oxidized insulating layer 13 of $SiO_2$) along the pyramidal protrusions 18 may be exposed to a depth of about 0.7 μm as illustrated in FIG. 1*f*. Thereafter, the parts of the gate electrode layer 19 overlying the tips 18*a* of the pyramidal protrusions 18 are removed by reactive ion etching to open the parts of the gate electrode layer 19 corresponding to the tips of the pyramidal protrusions 18 as illustrated in FIG. 1*g*.

Figure 1H:
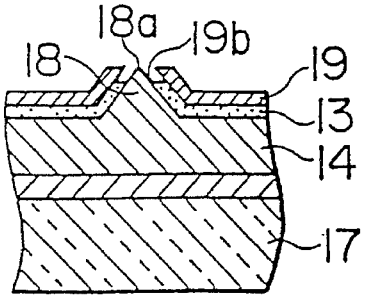

After the resist 20 is removed, the parts of the thermally oxidized insulating layer 13 of $SiO_2$ encircling the tips 18*a* of the pyramidal protrusions 18 are selectively removed by etching with a mixed solution of $NH_4F.HF$. As a result, opening parts 19*b* of the gate electrode layer 19 are formed and, at the same time, the tips 18*a* of the pyramidal protrusions 18 of the emitter material are exposed to give rise to pyramidal cathodes or emitters as illustrated in FIG. 1*h*.

Figure 2:
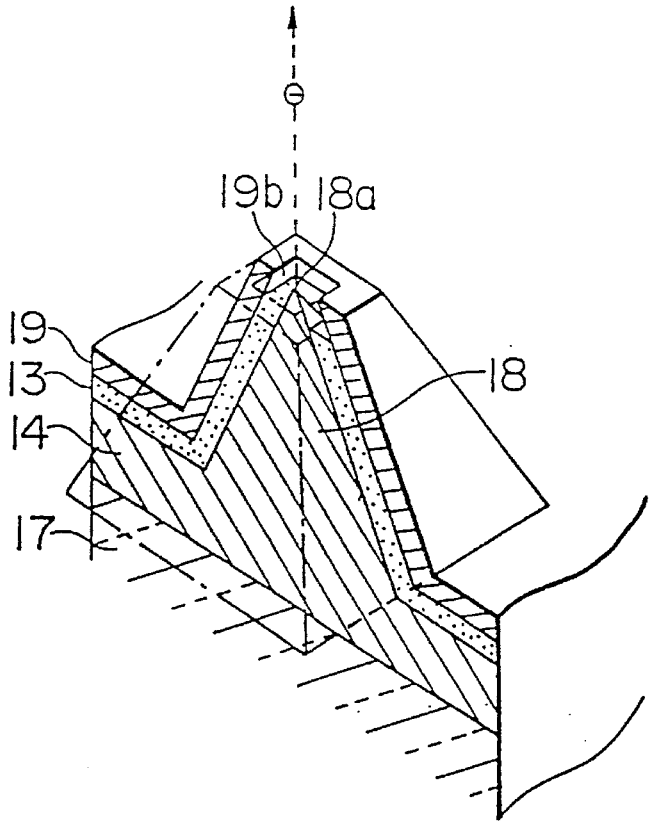
FIG. 2 is a partially sectioned perspective view illustrating a field emission cathode structure as one embodiment of this invention.

The construction of the field emission cathode structure obtained by the working example of production described above is illustrated in FIG. 2. Incidentally, FIG. 2 represents a case of omitting the formation of the ITO conductive layer 15. In the field emission cathode structure, the emitter material layer 14 concurrently serving as a cathode electrode layer is formed as held in direct contact on the glass substrate 17 serving as a structural substrate. On the emitter material layer 14, the pyramidal protrusions 18 are integrally formed as emitters (as W emitters, for example). The pyramidal emitters 18 correspond to the parts of the emitter material filling the interiors of the holes 12 formed in the Si single crystal substrate 11.

The pyramidal emitters 18 are covered with the thermally oxidized insulating layer 13 of $SiO_2$ except for the tips 18*a* thereof which are destined to form electron discharge parts. The W layer destined to serve as the gate electrode layer 19 is formed through the medium of the thermally oxidized insulating layer 13 of $SiO_2$. The gate electrode layer 19 is formed along the shapes of the pyramidal emitters 18 and is provided with the opening parts 19*b* which are formed so as to encircle the tips 18*a* of the emitters 18. The tips 18a of the pyramidal emitters 18 are positioned inside the openings 19*b* of the gate electrode layer 19 and are adapted to discharge electrons by way of field emission through the medium of the opening parts 19*b*.

In the working example described above, since the thermally oxidized insulating layer 13 of $SiO_2$ is formed first on the Si single crystal substrate 11 provided with the holes 12 and the emitter material layer 14 is subsequently formed by deposition, the field emission cathode structure consequently produced allows accurate control of the gaps between the gates and the emitters as compared with the conventional field emission cathode structure which has the insulating layer formed as by the technique of CVD. Generally, Si is used for the field emitters which by nature are subjected to anisotropic etching. The field emission cathode structure of this invention does not limit the material for emitters to Si. It instead allows use of various materials such as W which have a low work function. Since the pyramidal emitters 18 are formed by filling the holes 12 formed in the Si single crystal substrate 11 with the emitter material, the emitters 18 conforming to the shapes of the holes 12 can be produced with high repeatability. Since the holes 12 are enabled to assume the shape of an inverted pyramid having an ideally pointed bottom owing to the high repeatability of the shaping by anisotropic etching and the full growth of the thermally oxidized insulating layer 13 of $SiO_2$ within the holes 12, the pyramidal emitters 18 to be produced are allowed infallibly to acquire sharply pointed tips 18*a* of an eminently uniform height.

The emitters 18 of this quality enjoy a generous improvement in efficiency of field emission and uniformity thereof and make a great contribution to improving the efficiency and uniformity of various electronic devices using the field emission cathode structure. Further, in the field emission cathode structure of this invention, since the thermally oxidized insulating layer 13 of $SiO_2$ is formed along the pyramidal shapes of the emitters 18, the parts of the emitters other than the tips thereof serving to discharge electrons are electrically insulated. Thus, the concentration of electric fields to the tips is increased, the efficiency of field emission is enhanced, and the stability of the operation of field emission is improved.

Further, owing to the procedure which comprises forming the emitter material layer 14 inclusive of the pyramidal emitters 18 on the Si single crystal substrate (first substrate)11, joining this layer 14 to the structural substrate (glass substrate)17, and subsequently dissolving and removing the unnecessary Si single crystal, a multiplicity of Si single crystal substrates 11 having the pyramidal emitters 18 formed thereon can be integrated on one and the same structural substrate 17. Thus, the area for the formation of cathode parts can be easily enlarged and the formation of the field emission cathode structure of a large surface area can be accomplished. Since the unnecessary Si single crystal is dissolved and removed and, as a result, the emitter material layer 14 is made to assume the state of being directly (or through the medium of the conductor layer 15) superposed on the structural substrate 17, the produced field emission cathode structure does not suffer from an increase in thickness like the conventional cathode structure. Thus, cathode structures of a small thickness can be easily formed within a large area, indicating that the productivity of field emission cathode structures can be improved and the adaptability thereof to various electronic devices can be realized.

Moreover, the accurate control of the gaps between the gates and the emitters and the improvement of the reproducibility of the shapes of emitters 18 contribute to curbing the currents of electrons between the gates and the emitters. The emission of electrons, therefore, can be attained with high efficiency. In the flat panel display device, for example, the efficiency emission from the picture elements corresponding to the individual cathode parts can be heightened and, at the same time, the inconsistency of luminance among the picture elements can be curbed.

Figure 11A:
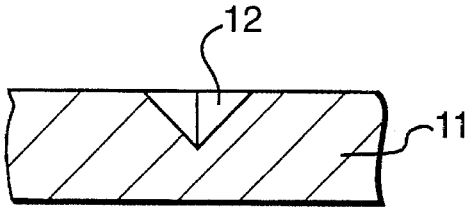
FIGS. 11*a*, 11*b*, 11*c*, 11*d*, 11*e*, 11*f*, 11*g*, and 11*h* are a series of model explanatory diagrams showing the second embodiment of the method for the production of a field emission cathode according to this invention.

Embodiment 2:

The second embodiment of this invention will be described with reference to FIGS. 11*a, b, c, d, e, f, g,* and *h.*

First, a Si single crystal substrate (first supporting substrate) 11 is prepared. One main surface of this supporting substrate 11 is anisotropically etched to form a hole 12 (in the shape of an inverted pyramid) having a tip part pointed at a prescribed angle as shown in FIG. 11*a.*

To be more specific, a thermally oxidized film ($SiO_2$ film) about 0.1 μm in thickness is formed as by the dry oxidation method on the main surface of a p-type Si single crystal substrate 11 having a crystal face orientation of (100) and a resist is applied by the spin coating method to the surface of the thermally oxidized film.

Then, the resist is patterned so as to obtain an opening of the shape of the square of 0.8 μm, for example, through the treatments of exposure and development with the aid of a stepper, the exposed area of the oxide film ($SiO_2$ film) is selectively etched with a mixed solution of $NH_4F.HF$, the resist is removed, and the anisotropic etching is carried out with an aqueous 30% KOH solution to give rise to the hole 12 of the shape of an inverted pyramid 0.56 μm in depth on the main surface of the Si single crystal substrate 11.

Subsequently, the thermally oxidized film which has served as the mask is removed with the mixed solution of $NH_4.HF$ and the Si layer 73 containing a P-type impurity at a concentration of not less than $3\times10^{19}$ $cm^{-3}$ such as, for example, a B-diffused Si layer 73 having a thickness of 0.3 μm, is superposed in a substantially uniform thickness on the surface of the Si single crystal substrate 11 containing the hole 12 of the shape of an inverted pyramid. The B-diffused Si layer 73 in this case functions as an etching stopper layer (sacrifice layer) during the removal of the Si single crystal substrate 11. This layer 73 can be used in its unmodified form as a gate electrode layer when the concentration of the p-type impurity is so high as to fall in the range of from $10^{20}$ to $10^{21}$ $cm^{-3}$ and the electric resistance is so low as to fall in the neighborhood of $10^{-4}$ Ω·cm. In this case, the number of man-hours can be decreased and the distance between the gate and the emitter can be shortened to permit desirable mutual approximation.

Then, the Si single crystal substrate 11 provided with the p-type impurity diffusion Si layer 73 is subjected to a treatment of thermal oxidation to effect thermal oxidation of the surface of the p-type impurity diffusion Si layer 73 and give rise to the insulator layer 13 having a thickness of 0.2 μm.

After the insulator layer 13 has been formed as described above on the surface of the p-type impurity diffusion Si layer, an emitter material such as, for example, W, Mo, or Ta is sputtered on the surface of the insulator layer 13 so as to fill the pyramidal hole covering the p-type impurity diffusion Si layer 73 and the insulator layer 13, form the emitter projection 18 conforming to the hole mentioned above, and also form the emitter material layer 14 having a smoothly finished surface and a thickness of about 0.8 μm.

Figure 11B:
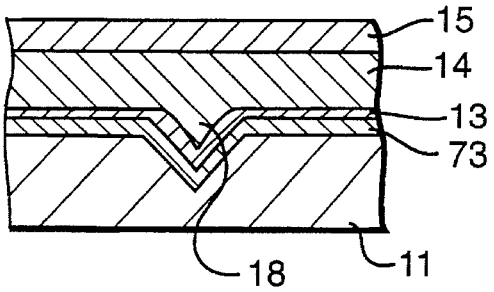

Further on the surface of the emitter material layer 14, an electroconductive layer 15 such as, for example, an ITO (indium-tin type oxide) layer 15 having a thickness of about 1 μm, is superposed as by sputtering to produce such a laminate as shown in FIG. 11*b*. Here, the ITO layer 15 may be omitted, depending on the material used for the emitter material layer 14. When this omission is made, the emitter material layer 14 goes to play the part of a cathode electrode layer concurrently.

Figure 11C:
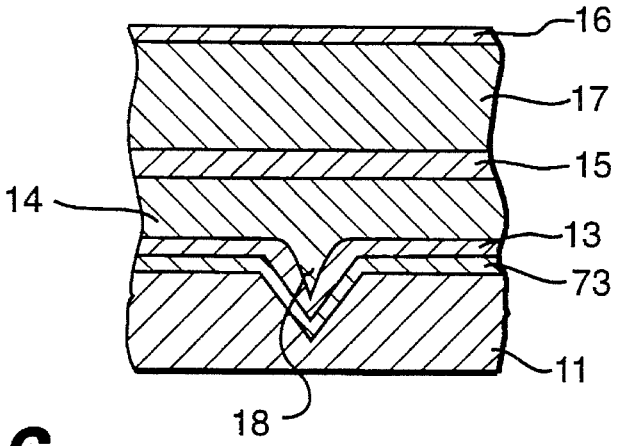

The second supporting substrate (structural substrate) such as, for example, a Pyrex glass sheet 17 having the rear surface (back surface) thereof coated with an Al layer 16 destined to serve as an electrostatic bonding electrode and having a thickness of about 0.4 μm is superposed on the laminate mentioned above. The ITO layer 15 and the Al layer 16 are interjoined by the so-called electrostatic bonding method which resides in applying a voltage of the order of some hundreds of V between the layers (FIG. 11*c*). Though this union of the two layers may be accomplished by the use of an adhesive agent, the electrostatic bonding method proves more advantageous from the viewpoint of providing the produced field emission cathode with greater reduction in weight and thickness.

After the Pyrex glass sheet 17 as the structural substrate has been joined to the laminate, the rear coat (Al) layer 16 of the Pyrex glass sheet 17 is removed by etching as with a mixed acid solution of $HNO_3.CH_3COOH.HF$, for example.

Figure 11D:
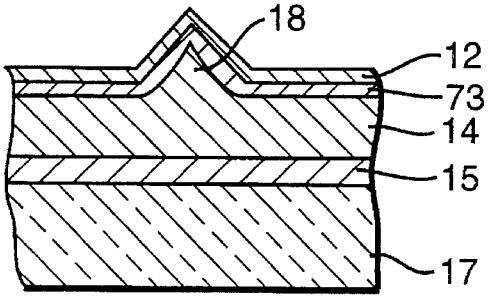

Then, the Si single crystal substrate 11 as the first supporting substrate is removed by etching by the use of an aqueous solution containing the mixture of ethylene diamine, pyrocatechol, and pyrazine (mixing ratio 75 cc:12 g:3 mg:10 cc) to give rise to a laminate composed of the insulator layer 13 and the emitter layer 14 provided with the pyramidal projection 18 (conforming to the aforementioned pyramidal hole 12) and covered by the p-type impurity diffusion Si layer 73 as shown in FIG. 11*d*. During this process of etching, the p-type impurity diffusion Si layer 73 functions as an etching stopper layer for the Si single crystal substrate 11 and discharges the role of protecting the insulator layer 13 having a small film thickness and the pyramidal projection 18 of the main body of the emitter having a sharp pointed tip against corrosion by the etching solution mentioned above.

Figure 11E:
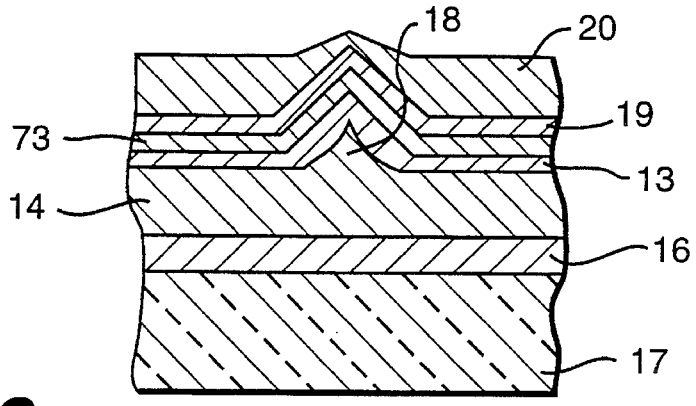

Then, on the surface of the p-type impurity diffusion Si layer 73 which has been exposed by the removal by etching of the Si single crystal substrate 11, W is deposited in the form of a coat in a thickness of about 0.5 μm as by the sputtering method, for example. To the surface of the W coat layer 19 formed as described above, a photoresist layer 20 is applied as by the spin coating method in a thickness such as, for example, about 0.9 μm which is enough to conceal a tip part 19*t* of the projection on the surface of the W coat layer 19 embracing therein the pyramidal projection 18 of the emitter as shown in FIG. 11*e*.

Figure 11F:
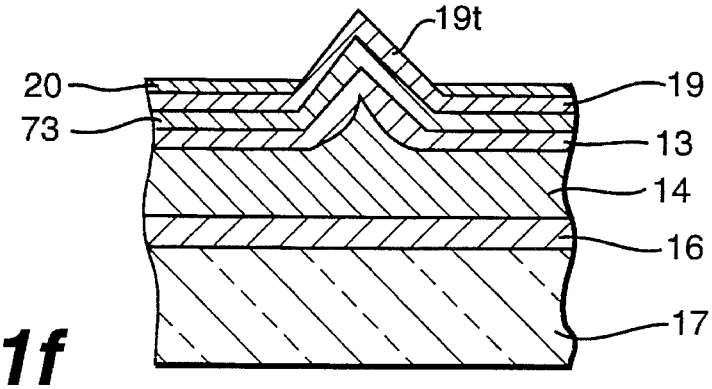

Thereafter, by the dry etching treatment using oxygen plasma, part of the photoresist layer 20 is removed so that the tip part 19*t* of the projection of the W coat layer containing the projection 18 of the emitter may be exposed in a thickness of about 0.7 μm through the surface as shown in FIG. 11*f*.

Figure 11G:
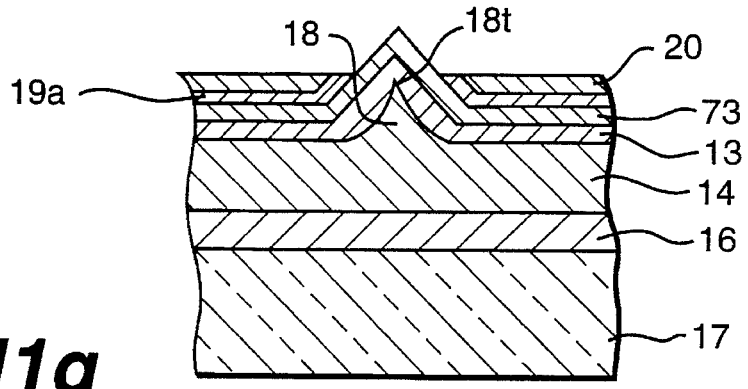

Subsequently, by the reactive ion etching treatment, the tip part 19*t* of the projection of the W coat layer 19 which has been exposed by the removal by etching of part of the photoresist layer 20 is selectively removed to form the gate electrode layer 19*a* provided with an opening 19*b* exposing the tip part of the projection covering the impurity diffusion layer 73 and the insulator layer 13 as shown in FIG. 11*g*.

The remainder part of the photoresist layer 20, namely the part which has functioned as a mask for the selective etching of the tip part 19*t* of the W coat layer, is subsequently removed. Then, the impurity diffusion layer 73 and the insulator layer 13 covering the tip part 18*t* of the projection 18 of the emitter are selectively removed by etching with the mixed solution of $NH_4F.HF$ so as to expose the tip part 18*t* of the projection 18 of the emitter 18.

Figure 11H:
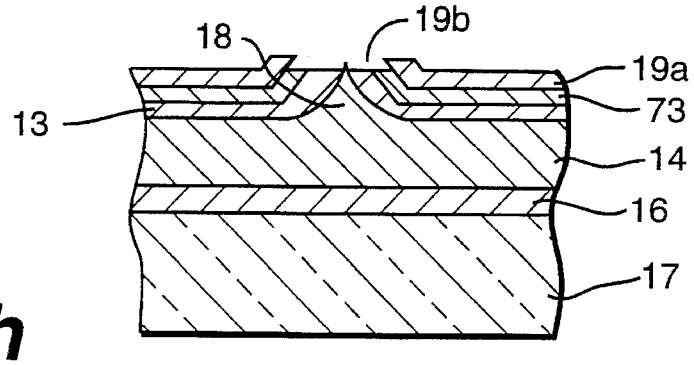

As a result, the field emission cathode is obtained which is so constructed as to expose the tip part 18*t* of the pyramidal projection 18 of the main body of the emitter through the opening 19*b* of the gate electrode layer 19*a* as shown in FIG. 11*h*.

In accordance with the method of production described above, the high-concentration impurity diffusion layer 73 doped with an impurity is formed on the surface of the supporting substrate 11 provided with the hole formed by anisotropic etching and pointed sharply in the tip (bottom surface side) thereof, the insulator layer 13 is further formed thereon by the thermal oxidizing method, and subsequently the emitter material layer 14 is formed in such a manner as to fill the hole mentioned above. During the course of this process, the hole having a sharply pointed tip is formed in a prescribed shape with high repeatability by the anisotropic etching. Further, since the formation of the insulator layer 13 by the thermal oxidation permits growth of $SiO_2$ of high density and since the high-concentration impurity diffusion layer 73 provides effective protection of the insulator layer 13 and the emitter material layer 14 against corrosion by etching, the emitter function part is formed which possesses a sharp pointed tip part uniform in height and shape and also excels in uniformity of quality.

Thus, the provision of field emission cathodes with stabilized quality can be realized. Further, since the insulator layer 13 can be formed in a fully accurately controlled thickness by the thermal oxidizing method, the distance between the emitter function part mentioned above and the gate electrode layer 19*a* (emitter-gate distance) is controlled with high accuracy. Thus, the field emission cathode is capable of operating at a relatively low voltage to effect highly efficient emission.

The embodiment described above represents a case of having the gate electrode layer 19*a* superposed on the surface of the impurity diffusion layer 73. The operation and effect of the embodiment under consideration are similarly attained by causing the impurity diffusion layer 73 to function as a gate electrode layer when this impurity diffusion layer 73 has a high impurity concentration and a high electric resistance or by removing the impurity diffusion layer 73 participating mainly in the selective etching of the supporting substrate 11 thereby exposing the insulator layer 13 and superposing the gate electrode layer 19*a* on the surface of the exposed insulator layer 13.

The effect manifested by the embodiment is invariable when the impurity mentioned above is a p-type B, Al, Ga, or In, an n-type P, As, or Ti, or an i-type Ge or Sn.

It is allowed in this invention to use as the material for the first supporting substrate such substance as GaAs in the place of Si single crystal and as the emitter material Mo, Ta, Si, or other substance having a low work function in the place of W.

The operation and effect of the present embodiment are obtained invariably when a soda glass plate is used in the place of the Pyrex glass plate as the second supporting substrate (structural substrate).

Further, the embodiment described above represents a case of handing the field emission cathode as a unitary article. As a matter of course, a group of such field emission cathodes may be arrayed in the form of a matrix, for example, on one Si single crystal sheet to produce a planar field emission cathode.

As described above, the field emission cathode of the first embodiment of this invention has originated in the interest drawn to the fact that a pyramidal or conical hole having a pointed tip can be formed on the surface of a supporting substrate by utilizing the anisotropy of etching, the fact that a region converted into an impurity diffusion layer functions as an etching stopper layer, the fact that the impurity diffusion layer functions concurrently as a gate electrode layer when it has low resistance, and the fact that an acute oxide layer (insulator layer) is formed in a highly accurately controlled shape along a prescribed surface by the use of the thermal oxidation method. The field emission cathode of the present invention always enjoys excellent qualities of constantly displaying ideal uniformity of field emission, providing an effective operation at a low voltage, and obtaining high field emission efficiency.

Further, in accordance with the method for the production of the field emission cathode of the present invention, the field emission cathode which is endowed with such functional characteristics as mentioned above and is easily adapted for high integration can be manufactured with highly satisfactory yield and productivity (ability of quantity production). Thus, the method of production contemplated by this invention may well be rated as contributing greatly to the utilization of field emission cathodes of this type in practical applications.

Figure 12A:
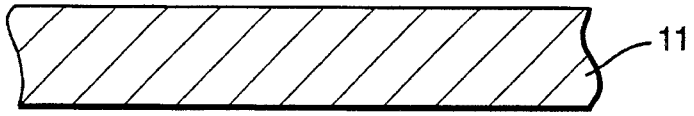
FIGS. 12*a*, 12*b*, 12*c*, 12*d*, 12*e*, and 12*f* are a series of model explanatory diagrams showing the third embodiment of the method for the production of the field emission cathode according to this invention.

Embodiment 3:

FIGS. 12*a, b, c, d, e,* and *f* are a series of diagrams showing a process for the production of a field emission cathode as the third embodiment of this invention. The method of production according to the third embodiment will be described below with reference to these diagrams. In these diagrams, like parts found in the second embodiment are denoted by like reference numerals.

First, as shown in FIG. 12*a*, the Si single crystal substrate 11 offering low resistance and having a crystal face orientation of (100) is prepared as a first supporting substrate.

Figure 12B:
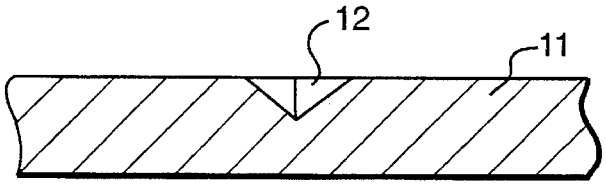
Figure 12C:
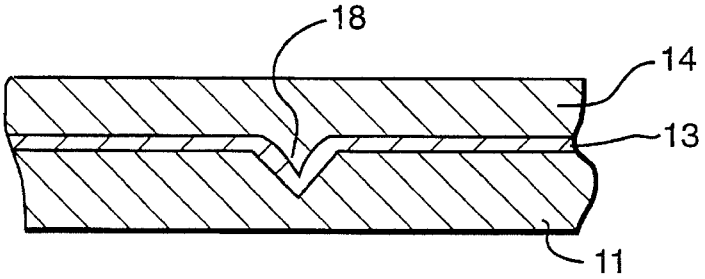

Then, the hole 12 sharply pointed toward the bottom part thereof is incised on one flat surface of the Si single crystal substrate 11 (hereinafter referred to as the first main surface) as shown in FIG. 12*b*. For the incision of the hole 12 of such a shape as described above, the method which utilizes the anisotropic etching of Si to be described hereinbelow may be adopted. To be specific, on the first main surface of the Si single crystal substrate 11 made of a Si single crystal having a crystal face orientation of (100), a thermally oxidized film of $SiO_2$ is superposed in a thickness of about 0.1 μm by the dry oxidizing method. Then, the photoresist is patterned so as to obtain an opening of the shape of the square of 1 μm, for example, through the treatments of exposure and development with the aid of a stepper and the thermally oxidized $SiO_2$ film is etched by the use of the mixed solution of $NH_4F.HF$ as an etchant. The photoresist is removed and the first main surface of the Si single crystal substrate 11 is subjected to the anisotropic etching by the use of an aqueous 30 wt % KOH solution as an etchant. As a result, the hole 12 of the shape of an inverted pyramid 0.71 μm in depth is incised on the first main surface side of the Si single crystal substrate 11. Then, the thermally oxidized $SiO_2$ film remaining on the surface of the Si single crystal substrate 11 is removed by the use of the mixed solution of $NH_4F.HF$, for example.

Subsequently, the thermally oxidized layer 13 is formed as shown in FIG. 3C on the first main surface of the Si single crystal substrate 11 including the inner wall surfaces of the hole 12 by subjecting the surfaces mentioned above to a treatment of thermal oxidation. In the present embodiment, the thermally oxidized layer 13 is formed by the wet method of thermal oxidation so as to acquire a thickness of 0.5 μm. Then, on this thermally oxidized layer 13, the emitter material layer 14 using W or Mo is formed. This emitter material layer 14 is so formed as to cover the upper surface of the thermally oxidized layer 13 while filling the hole 12. In the present embodiment, the emitter material layer 14 is deposited by the sputtering method so as to form a film 2 μm in thickness on the thermally oxidized layer 13 excepting the hole 12.

Figure 12D:
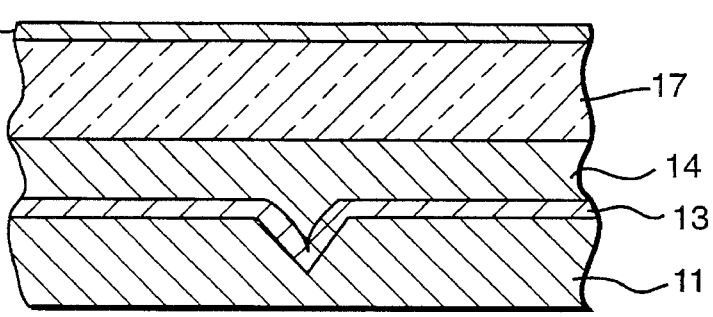

Then, as a second supporting substrate, the glass substrate 17 made of such a highly heat-resistant material as Pyrex glass and provided on the rear surface thereof with the Al layer 16 of a thickness of 0.3 μm as a coating as shown in FIG. 12*d* is prepared. This glass substrate 17 is superposed on and joined fast to the surface of the emitter material layer 14 opposite to the surface thereof on which the projection 18 of a sharp pointed tip. For this union, the electrostatic bonding method may be adopted, for example. Then, the Al layer 16 on the rear surface of the glass substrate 17 is removed with the mixed acid solution of $HNO_3.CH_3OOH.HF$.

Figure 12E:
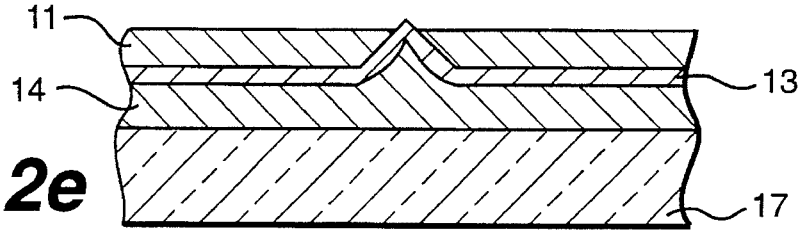

Then, the substrate in its entirety is inverted (upside down) so that the second main surface of the Si single crystal substrate 11 opposite to the first main surface thereof may fall on the upper side and the second main surface side of the Si single crystal substrate 11 opposite to the first main surface is removed by etching by the use of the so-called EDP, i.e. a mixed aqueous solution of ethylene diamine, pyrocatechol, and pyrazine (the ratio of ethylene diamine:pyrocatechol:pyrazine:water= 75 ml;12 g:0.45 g:10 ml in the present embodiment), as an etchant. In this case, the etching time is so controlled that the Si single crystal layer 11 may remain in a thickness allowing the tip part of the projection 18 of the emitter material layer 14 to be finally exposed and, at the same time, the lower part of the emitter material layer 14 to be coated with the Si single crystal layer 11 through the thermally oxidized layer 13 as shown in FIG. 12*e*. Thus, the Si single crystal substrate 11 is not wholly etched evenly in the direction of thickness thereof. The Si single crystal layer 11 is used as a gate electrode. Thus, the thermally oxidized layer 13 covering the sharply pointed tip part of the projection 18 of the emitter material layer 14 is exposed from the Si single crystal layer 11.

Figure 12F:
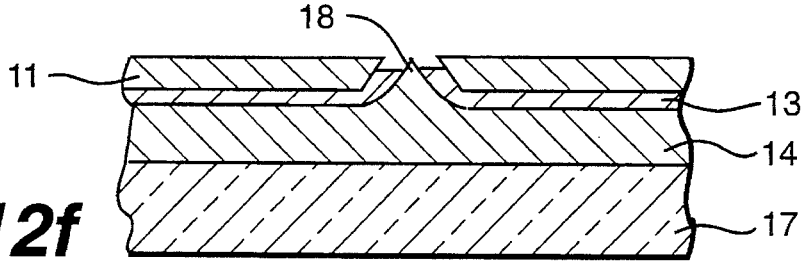

Now, the part of the thermally oxidized layer 13 which covers the tip part of the projection 18 of the emitter material layer 14 is removed by etching with the mixed solution of $NH_4F.HF$ as an etchant to expose the sharp pointed tip part of the projection 18 partly from the Si single crystal layer 11 as shown in FIG. 12*f*. Thus, the emitter is obtained.

The method of production described above has the effect of enabling the field emission cathode contemplated by this invention to be formed with ease in addition to the effect manifested by the method of production of the second embodiment.

Figure 13A:
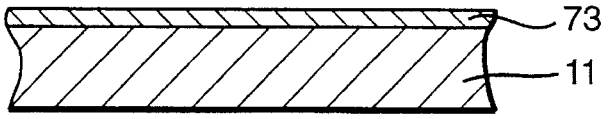
FIGS. 13*a*, 13*b*, 13*c*, 13*d*, 13*e*, and 13*f* are a series of model explanatory diagrams further showing the fourth embodiment of the method for the production of the field emission cathode according to this invention.

Embodiment 4:

FIGS. 13*a, b, c, d, e,* and *f* are a series of diagrams showing a process for the production of the field emission cathode of the fourth embodiment of this invention. The method production of the fourth embodiment will be explained below with reference to these diagrams. In these diagrams, like parts found in the second and the third embodiment are denoted by like reference numerals.

The present embodiment is characterized by superposing the etching stopper layer 73 having boron (B) diffused therein at a high concentration and having a small thickness on the Si single crystal substrate 11 and causing the advance of the etching of the Si single crystal substrate 11 from the second main surface side thereof to be stopped by this etching stopper layer 73. It, therefore, finds no use for such complicate control of the etching time as is encountered in the third embodiment and facilitates the formation of the field emission cathode of this invention to a greater extent.

First, the etching stopper layer 73 of a small thickness is formed on the first main surface of the Si single crystal substrate 11 having a crystal face orientation of (100) by diffusing on the surface mentioned above the ions of such an impurity as boron (B) at a high concentration of not less than $10^{19}$ $cm^{-3}$, for example. This high-concentration impurity diffusion is effected by the thermal diffusion method or the ion injection method, for example.

Figure 13B:
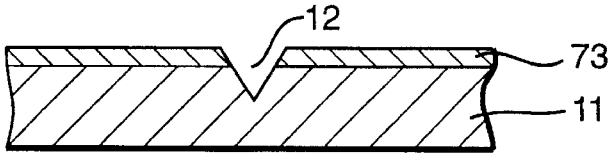
Figure 13C:
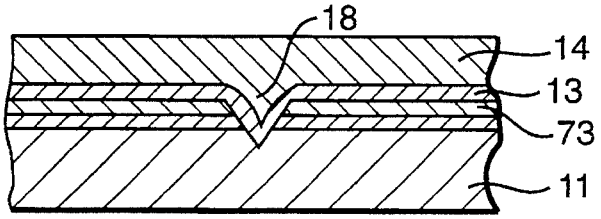

Then, as shown in FIG. 13*b*, the hole 12 pointed sharply toward the bottom part thereof is incised in the Si single crystal substrate 11 from the etching stopper layer 73 (first main surface) side in the same manner as in the second embodiment. For the incision of this hole 12, the method which resorts to the anisotropic etching of Si may be adopted similarly to the third embodiment. To be specific, the treatment of thermal oxidation by the dry method is performed on the surface of the etching stopper layer 73 to form a thermally oxidized $SiO_2$ film in the etching stopper layer 73 to a depth of about 0.1 μm. The photoresist (not shown) is further applied to the thermally oxidized $SiO_2$ film by the spin coating method. Then, the photoresist is patterned as by the treatments of exposure and development by the use of a stepper, for example, so as to obtain an opening in the shape of the square of 1 μm. The thermally oxidized $SiO_2$ film is subsequently patterned by the use of the mixed solution of $NH_4F.HF$ as an etchant. Then, the photoresist mentioned above is removed and the anisotropic etching is carried out with the pattern of the thermally oxidized $SiO_2$ film as an etching mask and the aqueous 30 st % KOH solution as an etchant. Thus, in the etching stopper layer 73, the hole 12 having the shape of an inverted pyramid is incised in a depth of 0.71 μm reaching beyond the first main surface of the Si single crystal substrate 11. Then, the thermally oxidized $SiO_2$ film remaining on the surface of the etching stopper layer 73 is removed by the use of the mixed solution of $NH_4F.HF$, for example.

Here, an ideal etching speed is obtained even when the etching stopper layer 73 is formed on the Si single crystal substrate 11 because the aqueous KOH solution manifests a practically equal etching rate on the etching stopper layer 73 having boron (B) diffused at a high concentration therein and the Si single crystal. Even when the etching stopper layer 73 is formed on the Si single crystal substrate 11 as in the present embodiment, therefore, the hole 12 can be ideally incised. Naturally, some other etchant may be used herein on the condition that it should be capable of etching the etching stopper layer 73.

Then, the treatment of thermal oxidation is performed on the wall surfaces of the etching stopper layer 73 and the Si single crystal substrate 11 which are exposed through the hole 12 and on the flat surface of the etching stopper layer 73 to form the thermally oxidized layer 13. During the course of the thermal oxidation, the etching stopper layer 73 gains in thickness. The thickness of the etching stopper layer 73 is set preparatorily during the formation of the Si single crystal substrate 11 so that the part of the thermally oxidized layer 13 covering the tip part of the pyramidal projection 18 may protrude from the etching stopper layer 73 even after the etching stopper layer 73 is inflated as described above. Then, in the same manner as in the third embodiment described above, such a material as W or Mo which makes an ideal emitter material is deposited on the thermally oxidized layer 13 to give rise to the emitter material layer 14.

Figure 13D:
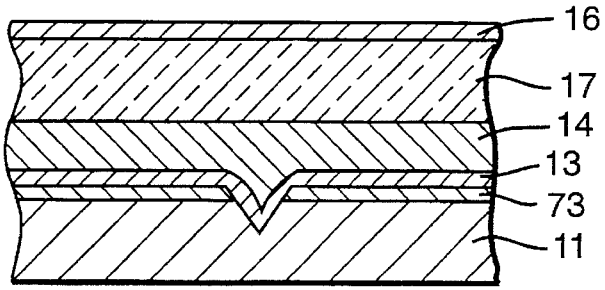

Now, similarly to the third embodiment, the glass substrate 17 made of such a highly heat-resistant material as Pyrex glass and provided on the rear surface thereof with the Al layer 16 having a thickness of 0.3 μm as a coating is prepared as shown in FIG. 13*d*. This glass substrate 17 is superposed on and attached fast to the surface of the emitter material layer 14 opposite to the surface thereof on which the pyramidal hole 18 pointed toward the tip thereof is formed. For this union, the electrostatic bonding method may be adopted similarly to the third embodiment. Then, the Al layer 16 on the rear surface of the glass substrate 17 is removed with the mixed acid solution of $HNO_3.CH_3OOH.HF$.

Figure 13E:
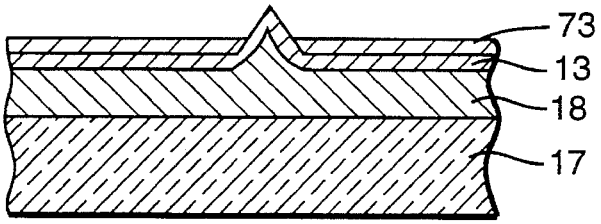

Then, as shown in FIG. 13*e*, the Si single crystal substrate 11 is removed by etching from the second main surface side opposite to the first main surface by the use of the so-called EDP, i.e. a mixed aqueous solution of ethylene diamine, pyrocatechol, and pyrazine (the ratio of ethylene diamine:pyrocatechol:pyrazine:water= 75 ml;12 g:0.45 g:10 ml in the present embodiment), as an etchant.

Here, since the etching stopper layer 73 is formed of a Si material having boron (B) diffused at a high concentration, the etchant like EDP which is used in the second embodiment manifests a considerably lower etching rate on the etching stopper layer 73 than on the single crystal of Si. As a result, the etching advancing in the Si single crystal substrate 11 from the second main surface side thereof is stopped by the etching stopper layer 73, with the result that the etching stopper layer 73 will remain practically intact. Thus, the thermally oxidized layer 13 covering the sharp pointed tip part of the projection 18 of the emitter material layer 14 can be partly exposed from the etching stopper layer 73.

Figure 13F:
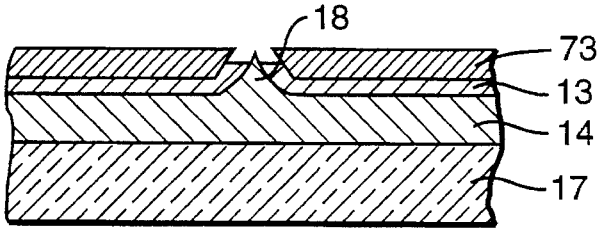

Then, as shown in FIG. 13*f*, the part of the thermally oxidized layer 13 covering the tip part of the projection 18 of the emitter material layer 14 is removed by etching with the mixed solution of $NH_4F.HF$ as an etchant to obtain partial exposure of the sharp pointed tip part of the projection 18 through the etching stopper layer 73. Thus, the emitter is obtained.

Incidentally, since the etching stopper layer 73 is formed of a Si material having boron (B) diffused therein at a high concentration and consequently enjoys high electric conductivity, it may be left in its unmodified form and used as a gate electrode.

The method of production of the fourth embodiment described above obviates the necessity of ensuring complicate control of the etching depth during the etching of the Si single crystal substrate 11 from the second main surface side thereof as involved in the third embodiment. It, therefore, brings about the effect of enabling the field emission cathode to be formed with further increased ease in addition to the effects obtained by the methods of production of the second and the third embodiment.

Figure 14A:
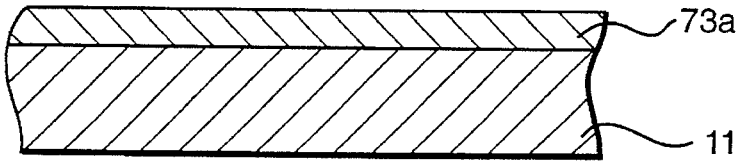
FIGS. 14*a*, 14*b*, 14*c*, 14*d*, 14*e*, and 14*f* are a series of model explanatory diagrams showing the fifth embodiment of the method for the production of the field emission cathode according to this invention.

Embodiment 5:

FIGS. 14*a, b, c, d, e,* and *f* are a series of diagrams showing a process for the production of the field emission cathode of the fifth embodiment of this invention. The method of production of the fifth embodiment will be explained with reference to these diagrams. In these diagrams, like parts found in the second and the third embodiment are denoted by like reference numerals. This fifth embodiment will be described below with emphasis centering on the characteristic parts thereof which differentiate this embodiment from the embodiments described above.

The method of production of the present embodiment is characterized by using an etching stopper layer 73*a* formed of an n-type Si material in the place of the etching stopper layer 73 of the third embodiment described above and causing the etching advancing in the Si single crystal substrate 11 from the second main surface to be stopped by applying a reverse voltage to the etching stopper layer 73*a*.

First, as shown in FIG. 14*a*, the Si layer 73*a* is formed in a small thickness as by the thermal diffusion method or the ion injection method on the Si single crystal substrate 11 made of a p-type Si single crystal having a crystal face orientation of (100) and the Si single crystal substrate 11 and the Si layer 73*a* are joined by the pn junction across the interface.

Figure 14B:
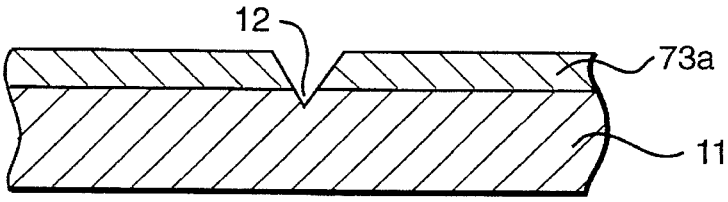
Figure 14C:
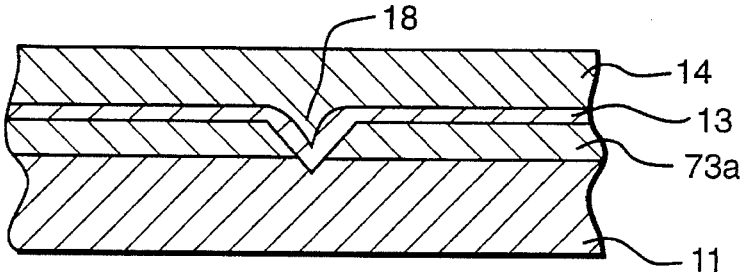
Figure 14D:
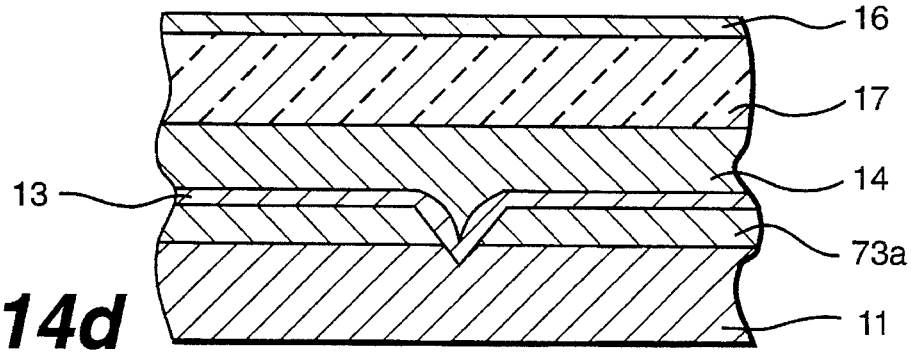

The subsequent steps shown in FIGS. 14*b* through 14*d* are practically the same as the corresponding steps used in the fourth embodiment described above.

Figure 14E:
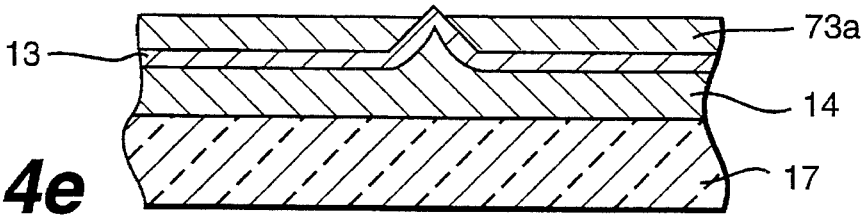

The present embodiment is then characterized by adopting the electrochemical etching method at the step of removing the Si single crystal substrate 11 shown in FIG. 14*e*.

This method resides in applying reverse voltage to the pn junction produced in the interface between the etching stopper layer 73*a* and the Si single crystal substrate 11 in an aqueous KOH solution, for example, thereby selectively etching the p-type Si single crystal substrate 11 exclusively and allowing the n-type Si layer 73*a* to remain intact in spite of the etching.

Thus, the Si single crystal substrate 11 is progressively etched from the second main surface side thereof until the Si single crystal substrate 11 is corroded out practically throughout the entire thickness thereof and only the tip part of the projection 18 of the emitter material layer 14 is exposed through the etching stopper layer 73*a*.

Figure 14F:
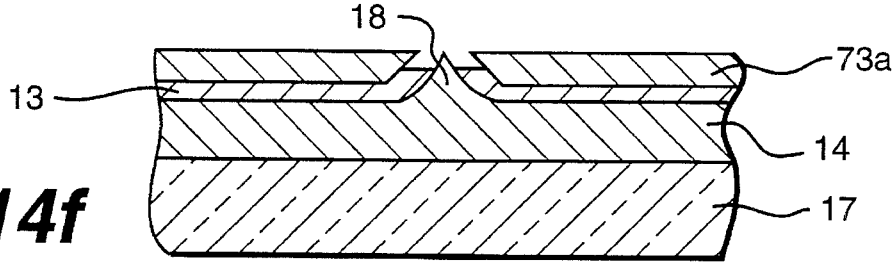

The steps which follow are identical to the corresponding steps involved in the embodiments described above. Specifically, the part of the thermally oxidized layer 13 covering the tip part of the projection 18 of the emitter material layer 14 is removed by etching with the mixed solution of $NH_4F.Hf$ as an etchant as shown in FIG. 14*f*. Thus, the sharp pointed tip part of the projection 18 is partly exposed through the Si single crystal layer 73*a*. The emitter is obtained as a result.

Similarly to the embodiments described above, the fifth embodiment under consideration offers the method of production which enables the gap between the emitter and the gate electrode to be formed accurately and easily.

In the fourth and the fifth embodiment described thus far, the etching stopper layer 12 having boron (B) diffused therein at a high concentration or the n-type Si layer 73*a* may be preparatorily formed by epitaxial growth on the first main surface of the Si single crystal substrate 11 at the step of FIG. 13*a* or FIG. 14*a*.

Naturally, the materials for the component layers, the formation of the layers in the form of film, the method of patterning, and the like may be variously altered without departing from the spirit of the present invention.

As clearly described in detail above, this invention has been perfected for the purpose of realizing the fact that a pyramidal or conical hole pointed toward the tip thereof can be formed in a supporting substrate by utilizing the anisotropy of etching, the fact that a region converted into an impurity diffusion layer functions as an etching stopper layer, the fact that this impurity diffusion layer functions concurrently as a gate electrode layer depending on the magnitude of resistance thereof, and the fact that an acute oxide layer (insulator layer) can be formed accurately along prescribed surfaces by utilizing the thermal oxidation method.

The field emission cathode according to this invention is endowed with excellent qualities of constantly manifesting ideal field emission uniformly, operating effectively even at a low voltage, and obtaining high efficiency in field emission. Then, the method of this invention for the production of a field emission cathode allows field emission cathodes which are furnished with such functional characteristics as mentioned above and are readily adapted for further integration to be manufactured in a highly satisfactory yield with an ability of quantity production (mass production).

Now, the flat panel display device using the field emission cathode structures obtained by the aforementioned working example will be described specifically below.

Figure 3:
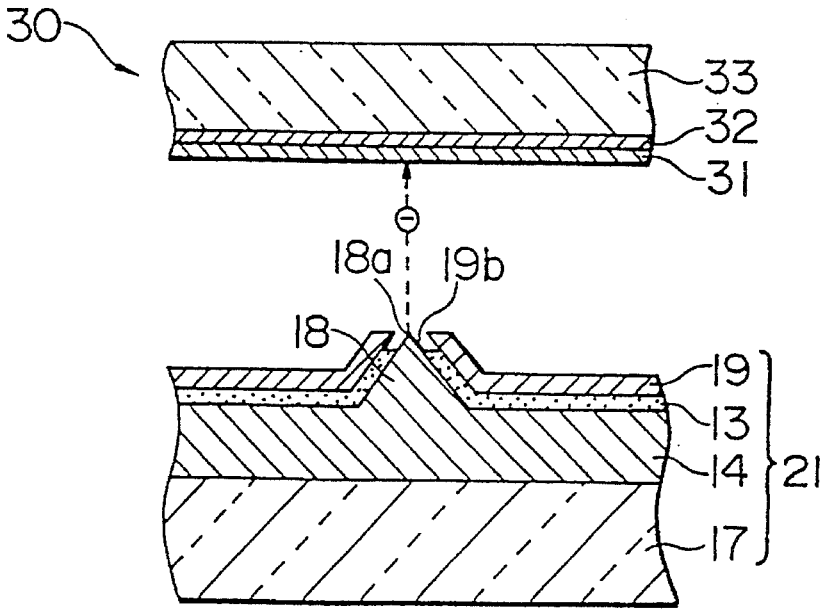
FIG. 3 is a cross section illustrating the essential part of a flat panel display device as one embodiment of this invention.

In the flat panel display device 30 of the present working example, the glass substrate 17 having a multiplicity of field emission pyramidal emitters 18 formed thereon (hereinafter referred to as "cathode plate 21") and a glass face plate 33 having a phosphor layer 31 and a transparent electrode (anode electrode) layer 32 made of ITO sequentially superposed thereon are opposed across a prescribed gap to each other as illustrated in FIG. 3 and they jointly form a vacuum housing. Thus, the cathode plate 21 is used as part of the vacuum housing.

Figure 4:
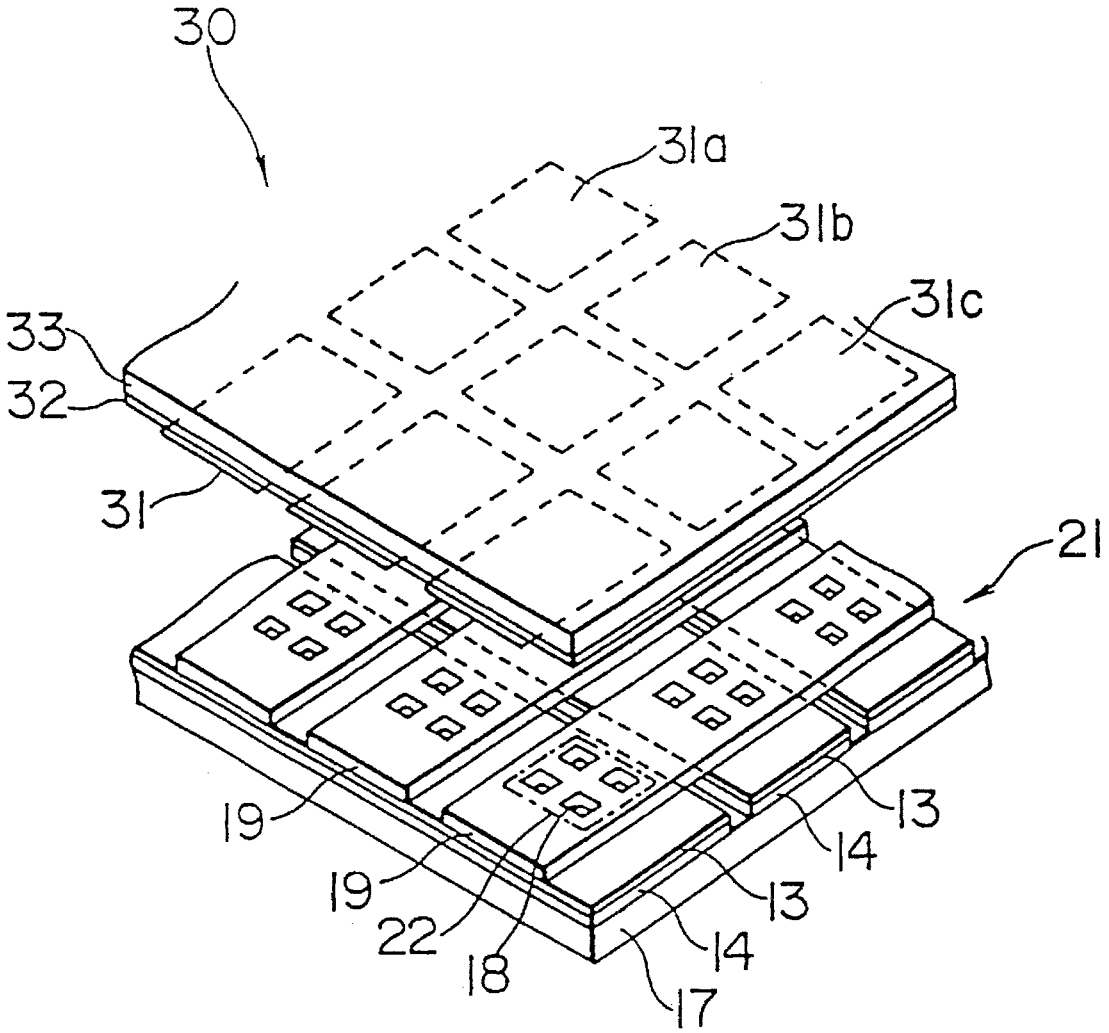
FIG. 4 is a perspective view illustrating the construction of the essential part of the flat panel display device shown in FIG. 3.

On the cathode plate 21, the emitter material layers 14 concurrently serving as cathode electrodes and gate electrode layers 19 are arranged after the fashion of a mutually intersecting network as illustrated in FIG. 4 and cathode forming regions 22 destined to form individual picture elements are set in place one each at the points of intersection of the network. The cathode forming regions 22 corresponding one each to the picture elements are severally provided with a multiplicity (50, for example) of pyramidal emitters 18. The phosphor layers 31 formed on the glass face plate 33 are each composed of a red emission phosphor layer 31*a*, a green emission phosphor layer 31*b*, and a blue emission phosphor layer 31*c* which correspond to each picture element. These phosphor layers are disposed correspondingly to the cathode forming regions 22. The phosphor layers 31*a*, 31*b*, and 31*c* are arranged as sequentially repeated in the horizontal direction.

When the flat panel display device 30 constructed as described above is operated by applying a voltage of 30 V between the gates and the cathodes and a voltage of 200 V between the anodes and the cathodes in accordance with a picture element signal, it produces an image of fine quality which excels in the luminance of light from the picture elements and suffers from inconsistency of the luminance among the picture elements only sparingly.

In the flat panel display device of this working example, images excelling in luminance of emitted light and suffering only sparingly from inconsistency of luminance of the emitted light can be infallibly produced because the pyramidal field emitters 18 used in the device excel in accuracy of shaping and uniformity of shape and, at the same time, enjoy outstanding accuracy of the control of the gaps between the gates and the emitters. Further, since the field emission cathodes used in the device excel in the efficiency of emission of electrons, they make a contribution to a decrease in the power consumption by the device.

The cathode plate 21 which forms part of the vacuum housing has the glass substrate (structural substrate) 17 as its base and, therefore, possesses strength enough to withstand a high degree of vacuum. Further, when a multiplicity of Si single crystal substrates (11) having emitters 18 formed in advance thereon are deposited fast on the glass substrate 17 during the manufacture of cathodes, the flat panel display device can be easily produced as furnished with a large image screen. Even in this case, the glass substrate can maintain sufficient strength.

Figure 5:
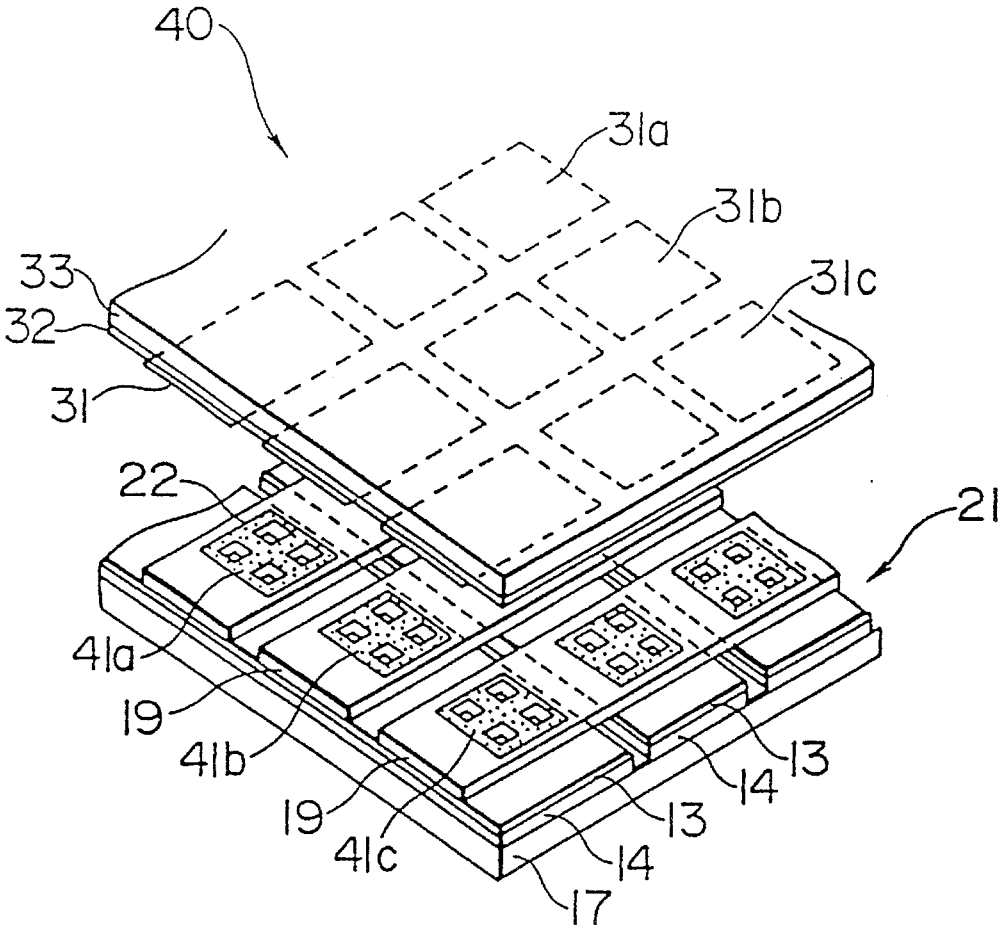
FIG. 5 is a perspective view illustrating the construction of the essential part of a flat panel display device as another embodiment of this invention.

Now, the flat panel display device produced in another working example of this invention will be described below with reference to FIG. 5.

In the flat panel display device 40 of this working example, a red emission phosphor layer 41*a*, a green emission phosphor layer 41*b*, and a blue emission phosphor layer 41*c* are severally formed as second phosphor layers on the gate electrode layer 19 corresponding to a relevant cathode forming region 22. These phosphor layers 41*a*, 41*b*, and 41*c* on the gate electrode layer 19 side are respectively identical in color to the opposed phosphor layers 31*a*, 31*b*, and 31*c* on the glass face plate 33 side. The phosphor layers 41*a*, 41*b*, and 41*c* on the gate electrode layer 19 side may be formed by the technique of spattering, for example. When the size of each picture element is large, they may be formed by the printing technique. The construction of the flat panel display device 40 except for what has been described above is presumed to be identical to that of the flat panel display device 30 described above.

When the flat panel display device 40 constructed as described above is operated by applying a voltage of 30 V between the gates and the cathodes and a voltage of 200 V between the anodes and the cathodes in accordance with a picture element signal, it produces an image of ideal quality which further excels in luminance of emission of light from the picture elements and suffers only sparingly from inconsistency of luminance among the picture elements.

In the conventional field emission cathode structure, the discharge current (electron current) between the cathodes and the anodes is approximately 50% to 80% of the discharge current obtained in the conventional C-CRT, with most of the remainder of the current flowing between the gates and the cathodes. When the phosphor layers 41*a*, 41*b*, and 41*c* are formed in advance also on the gate electrode layer 19 as in the flat panel display device 40 of the present working example, these layers emit light efficiently and the light is reflected by the gate electrode layer 19 itself which is made of a metallic material. Thus, the gate electrode layer 19 assumes the function of a metal back. The device, therefore, acquires a high efficiency of emission because the light emitted from the phosphor layers 41 on the gate electrode layer 19 and the light emitted from the phosphor layers 31 on the face plate 33 cooperates.

Figure 9A:
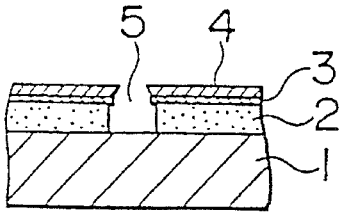
FIGS. 9*a*, 9*b* and 9*c* are cross sections illustrating a process for the production of a conventional field emission cathode structure.
Figure 9B:
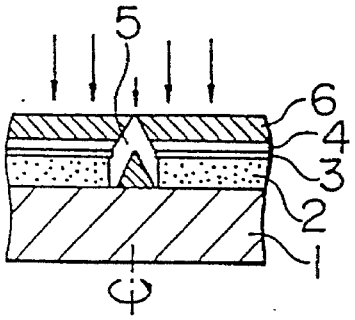
Figure 9C:
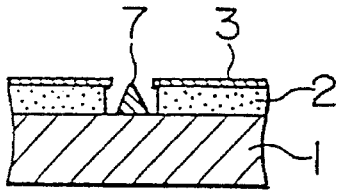
Figure 10:
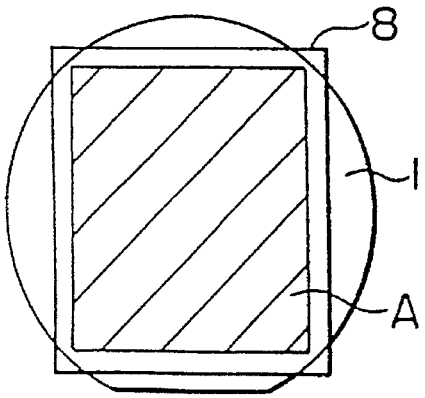
FIG. 10 is a diagram to aid in explaining the construction of the conventional flat panel display device.

The flat panel display device 40 of the preceding working example has been depicted as using pyramidal cathodes of this invention. The phosphor layers on the gate electrode layer are not limited to those involved in this particular device 40. The field emission cathodes produced by various methods of manufacture can be effectively utilized for the fabrication of the device in question. Particularly when the conventional cathodes produced by the technique of rotary vacuum deposition illustrated in FIG. 9 which are considered to generate large currents of emission between the gates and the cathodes are adopted, the second phosphor layers on the gate electrode layer manifest their effect more conspicuously.

Figure 6:
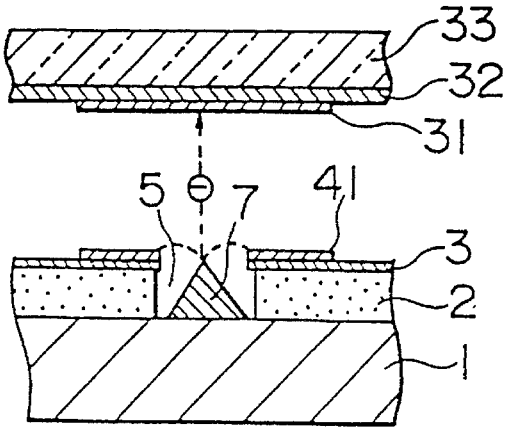
FIG. 6 is a cross section illustrating the essential part of a flat panel display device as yet another embodiment of this invention.

When the emitter 7 formed by the technique of rotary oblique vacuum deposition in the pinhole 5 dug in the insulating layer 2 of $SiO_2$ superposed on the Si single crystal substrate 1 as illustrated in FIG. 6 is used, the second phosphor layer 41 is disposed on the gate electrode layer encircling the pinhole 5. By the use of this construction, the favorable efficiency of emission can be obtained and the inconsistence of luminance among the picture elements can be curbed even when there is used the emitter 7 produced by the technique of rotary oblique vacuum deposition which entails heavy inconsistency in the distances between the gates and the emitters and in the shapes of emitters and tends to enlarge the currents of emission between the gates and the cathodes.

Now, the procedure for the production of the field emission cathodes for use in the flat panel display device contemplated in yet another working example of this invention which has phosphor layers formed also in the opening parts of emitters in the gate electrode layer will be described below with reference to FIG. 7.

Figure 7A:
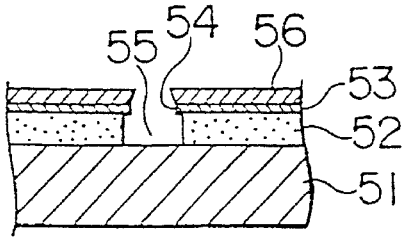
FIGS. 7*a*, 7*b*, 7*c* and 7*d* are cross sections illustrating a process for the production of a flat panel display device as still another embodiment of this invention.

First, an insulating layer 52 of $SiO_2$ 1.2 μm in thickness is formed by the technique of CVD on a Si substrate 51. Then, a Mo layer 53 0.5 μm in thickness is formed by the technique of electron beam vacuum deposition on the insulating layer 52 of $SiO_2$. A resist is applied to the Mo layer 53 by the technique of spin coating and subjected to patterning by exposure to an electron beam. After the resist is removed, the Mo layer 53 is selectively etched to form an opening part 54. After the resist is completely removed, the insulating layer 52 of $SiO_2$ is etched with a HF solution to form a hole 55 in the insulating layer 52 of $SiO_2$. Then, the Si substrate 51 is rotated parallelly to the surface of the substrate and Al is obliquely vacuum deposited as a separating layer on the Mo layer 53 to give rise to an Al layer 56. The process described thus far is depicted in FIG. 7*a*.

Figure 7B:
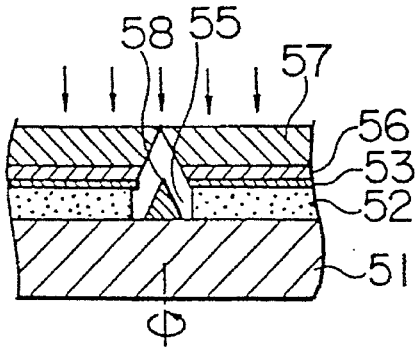

Then, the Si substrate 51 is rotated parallelly to the surface of the substrate and, at the same time, Mo is deposited on the Si substrate 51 perpendicularly thereto by the technique of electron beam vacuum deposition. Since a Mo layer 57 is deposited not only on the Al layer 56 and the Si substrate 51 but also on the lateral surfaces of the Al layer 56, the diameter of the opening part 54 gradually decreases. Since the range of vacuum deposition of Mo on the Si substrate 51 inside a hole 55 continues to decrease in consequence of the decrease of the diameter, a conical emitter 58 of Mo is formed on the Si substrate 51. The process thus far described is depicted in FIG. 7*b*.

Figure 7C:
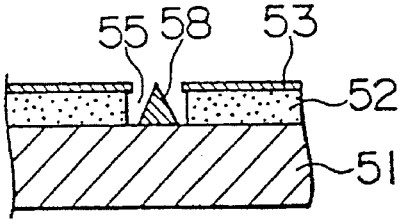
Figure 7D:
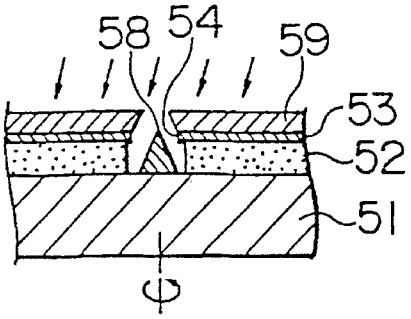

After the Mo layer 57 and the Al layer 56 are moved [FIG. 7*c*], the Si substrate 51 is rotated parallelly to the surface of the substrate and, at the same time, red, green, and blue phosphor layers 59 are deposited in an oblique direction such as, for example, at an angle of 75 degrees relative to the axis of rotation by the technique of oblique vacuum deposition or oblique spattering to give rise to the opening part 54. Thus the cathode of the present working example is completed. The process thus far described is illustrated in FIG. 7*d*.

The flat panel display device using the cathode plate which is obtained as described above allows the currents of electrons between the gates and the cathodes to be injected efficiently into the phosphor layers 59 as compared with the flat panel display device of the preceding working examples having the phosphor layers formed only on the gate electrode layer because the phosphor layers are formed additionally in the opening parts 54 of the gate electrode layer (Mo layer 53). When this flat panel display device is operated by applying a voltage of 30 V between the gates and the cathodes and a voltage of 200 V between the anodes and the cathodes, therefore, it produces an image of still better quality enjoying high luminance of the picture elements and suffering only sparingly from inconsistency of luminance.

Now, as another working example of the electron device of this invention, an electron beam drawing device will be described below with reference to FIG. 8.

Figure 8:
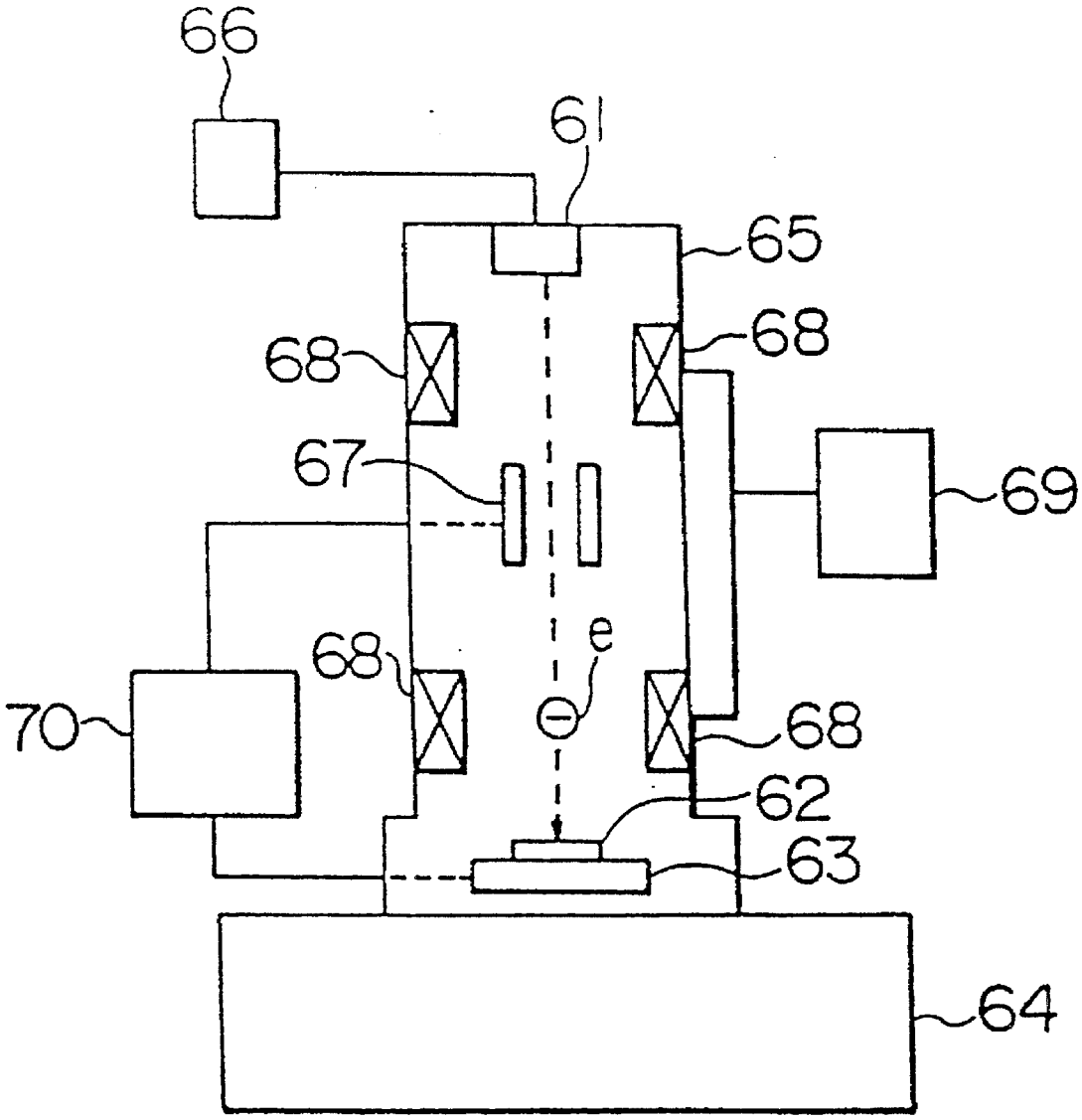
FIG. 8 is a diagram illustrating schematically the construction of an electron beam drawing device using a field emission cathode structure as one embodiment of this invention.

FIG. 8 is a schematic diagram of the electron beam drawing device using the field emission cathode structures manufactured as described in the preceding working example. In the diagram, 61 stands for a field emission cathode provided with pyramidal emitters and manufactured as described in the preceding working example, 62 for a Si wafer, 63 for a stage, and 64 for a shock-absorbing base. The electron beam e radiated from the field emission cathode 61 into the interior of a container 65 which is maintained at a high degree of vacuum (about $7\times10^{-8}$ Torr) is modulated (on/off control) in accordance with a signal of picture information by means of an electron source drive device 66 and also deflected in accordance with the signal of drawing information by a deflecting electrode 67 in the same manner as with the electron source drive device 66 to draw a pattern on the Si wafer 62. In the present working example, for the purpose of improving the convergence of the electron beam e emitted as described above, a converging electromagnetic lens 68 is installed and is controlled with an electromagnetic lens drive device 69. The stage 63 and the deflecting electrode 67 are synchronized by means of a synchronizing control mechanism 70.

In the electron beam drawing device constructed as described above, a fine pattern is drawn on the Si wafer 62 by applying a voltage of 30 V to the field emission cathode 61 thereby effecting emission of electron beam e and, at the same time, carrying out the deflection of the electron beam e and the motion of the stage 63 in accordance with the signal of drawing information.

The preceding working examples represent cases of using the field emission cathode structures of this invention in the flat panel display device and the electron beam drawing device. These are not the only devices that allow practical application of the field emission cathode structures of this invention. Other various electronic devices such as, for example, ultraspeed microwave devices, power devices, and electron beam devices equally allow effective use of the field emission cathode structures of this invention.

As described above, the method for the production of the field emission cathode structure contemplated by this invention allows stable production of emitters excelling in reproducibility of shape and uniformity (sharpness of tips, for example) and permits accurate control of gaps between the gates and the emitters. Thus, field emission cathode structures of high quality enjoying excellent efficiency of field emission and thoroughly curbing the inconsistency of the efficiency can be manufactured with high reproducibility. Since the cathode structures are allowed to utilize enlarged regions for the formation of their own without entailing an increase in thickness, they lend themselves to enhancing the productivity of the operation embodying the invention and, at the same time, realizing effective adaptation for various electronic devices. Further, the field emission cathode structure of this invention manifests ample strength when it is used as part of the housing of a device and, therefore, can be used suitably in the flat panel display device, for example. The present invention enhances the luminance of the light emitted from the picture elements and curbs the inconsistency of the luminance among the individual picture elements.

What is claimed is:

1. A method for the production of a field emission cathode structure, comprising the steps of:

providing a first substrate with holes of a sharp point;

forming an insulating layer on the surface of said first substrate inclusive of the surface of said holes;

forming an emitter material layer on said insulating layer and, at the same time, filling the interiors of said holes with said emitter material;

joining said first substrate covered with said emitter material layer to a second substrate made of a structural substrate through the medium of said emitter material layer, removing said first substrate by etching from said joined substrates so as to expose said insulating layer thereby allowing protrusions made of said emitter material filling the interiors of said holes and possessing said insulating layer as a surface layer thereof to thrust out;

forming a gate electrode layer on said insulating layer inclusive of said protrusions; and removing part of said insulating layer and said gate electrode layer at the tips of said protrusions thereby giving birth to emitters possessing an exposed tip.

2. A method according to claim 1, wherein said insulating layer is obtained by thermally oxidizing the surface of said first substrate.

3. A method according to claim 1, wherein a conductive layer is formed on said emitter material layer.

4. A method according to claim 1, wherein said union of said first substrate and said second substrate is attained by the technique of electrostatic bonding.

5. A method for the production of a field emission cathode structure, comprising the steps of:

preparing a first substrate made of a single crystal material;

selectively etching said first substrate thereby forming on the surface of said substrate at least one hole having a sharp point;

forming an oxide layer on the surface of said first substrate provided with said at least one hole;

forming an emitter material layer in a uniform thickness on said oxide layer and, at the same time, filling said at least one hole with said emitter material;

preparing a second structural substrate made of a glass material;

joining said first substrate provided on the surface thereof with said emitter material layer to said second structural substrate through the medium of said emitter material layer;

removing by etching from the union of said first and second substrates said first substrate made of said single crystal material thereby exposing said oxide layer having disposed therein at least one protrusion possessing a sharp tip;

forming a gate electrode layer on said oxide layer;

removing said oxide layer and said gate electrode layer by etching thereby exposing the tip of emitter in at least one protrusion covered by said oxide layer and said gate electrode layer and forming an opening part in the part of said gate electrode layer corresponding to said at least one protrusion; and further removing by etching said oxide layer between said tip of emitter and said gate electrode layer in the opening part of said gate electrode layer thereby exposing the tip of emitter of said protrusion.

6. A method according to claim 5, further comprising the step of forming a conductive layer on said emitter material layer.

7. A method according to claim 5, wherein the union of said first substrate and said second substrate is attained by the technique of electrostatic bonding.

8. A method for the production of a field emission cathode structure comprising an emitter provided with a sharp point for emission of electrons and a controlling gate electrode, characterized by comprising a step of forming a first hole having a sharp pointed tip on a first (supporting) substrate, a step of forming an impurity diffusion layer on the surface of said first (supporting) substrate including said first hole, a step of forming an insulator layer on the surface of said impurity diffusion layer including said hole, a step of depositing an emitter material layer on the surface of said insulator layer including said hole while filling said hole with the emitter material, a step of integrally joining a second substrate to the surface of said emitter material layer, a step of removing by etching said first substrate thereby exposing the surface of said impurity diffusion layer provided with a projection corresponding to said first hole, and a step of selectively removing said impurity diffusion layer and said insulator layer thereby exposing a tip of the projection of said emitter material layer.

9. A method according to claim 8, wherein said impurity diffusion layer is formed as a gate electrode layer.

10. A method according to claim 8, which further comprises a step of forming a gate electrode layer on the surface of said impurity diffusion layer after the step of removing by etching said first supporting substrate thereby exposing the surface said impurity diffusion layer provided with a projection corresponding to said first hole and the step of selectively removing said impurity diffusion layer and said insulator layer thereby exposing the tip of the projection of said emitter material layer.

11. A method according to claim 8, wherein the integral union of said emitter material layer and said second supporting substrate is carried out by the electrostatic bonding method.

12. A method according to claim 8, wherein the formation of said insulator layer is effected by thermally oxidizing said impurity diffusion layer.

13. A method according to claim 8, wherein said impurity diffusion layer is formed by doping at least one element selected from the group consisting of B, Al, In, P, As, Ti, Ge, and Sn as an impurity into Si.

14. A method according to claim 13, wherein the concentration of said impurity is not less than $3\times10^{19}$ $cm^{-3}$.

15. A method for the production of a field emission cathode comprising an emitter provided with a sharp point for emission of electrons and a controlling gate electrode, characterized by comprising a step of forming a hole having a sharp point on a first supporting substrate, a step of forming an insulator layer on the surface of said first supporting substrate including said hole, a step of depositing an emitter material layer on the surface of said insulator layer including said hole while filling said hole with an emitter material, a step of integrally joining a second supporting substrate to the surface of said emitter material layer, a step of etching said first supporting substrate through the exposed surface thereof until the end of a tip of the projection of said emitter material layer provided with the projection corresponding to said hole falls flush with the surface of said first supporting substrate after completion of said etching, and a step of selectively removing said insulator layer thereby exposing the tip of the projection of said emitter material layer.

16. A method for the production of a field emission cathode comprising an emitter provided with a sharp point for emission of electrons and a controlling gate electrode, characterized by comprising a step of forming an etching stopper layer on the first main surface of a first supporting substrate, a step of forming a hole having a sharp pointed tip on said first main surface side of said supporting substrate through said etching stopper layer to a depth reaching halfway along the thickness of said first supporting substrate, a step of forming an insulator layer on the surface of said etching stopper layer including said hole, a step of depositing an emitter material layer on the surface of said insulator layer including the hole while filling said hole with an emitter material, a step of integrally joining a second supporting substrate to the surface of said emitter material layer, a step of removing by etching said first supporting substrate from a second main surface side thereof until said etching stopper layer thereby exposing an end part of said insulator layer corresponding to said hole, and a step of selectively removing said insulating layer thereby exposing a tip of a projection of said emitter material corresponding to said hole.

* * * * *